US005627628A

United States Patent [19]

Soda et al.

[11] Patent Number: 5,627,628

[45] Date of Patent: May 6, 1997

[54] ELECTROPHOTOGRAPHIC APPARATUS

[75] Inventors: Kazunori Soda, Tenri; Shigeharu Maehara, Ikoma-gun, both of Japan

[73] Assignee: Sharp Kabushiki Kaisha, Osaka, Japan

[21] Appl. No.: 609,108

[22] Filed: Feb. 29, 1996

[30] Foreign Application Priority Data

Mar. 7, 1995 [JP] Japan ..... 7-047508

[51] Int. Cl.[6] ..... G03G 21/14; G03G 15/20

[52] U.S. Cl. ..... 399/46; 399/51; 399/69

[58] Field of Search ..... 355/208, 203, 355/204, 285, 286, 288, 228, 229; 219/216

[56] References Cited

U.S. PATENT DOCUMENTS

| | | | |
|---|---|---|---|
| 4,534,642 | 8/1985 | Miura et al. . | |
| 4,857,960 | 8/1989 | Hosaka et al. | 355/208 |

FOREIGN PATENT DOCUMENTS

| | | |
|---|---|---|
| 0239277 | 9/1987 | European Pat. Off. . |
| 58-53552 | 12/1983 | Japan . |
| 59-137964 | 8/1984 | Japan . |
| 59-229574 | 12/1984 | Japan . |
| 60-039669 | 3/1985 | Japan . |
| 60-039660 | 3/1985 | Japan . |
| 61-126571 | 6/1986 | Japan . |
| 61-237107 | 10/1986 | Japan . |
| 4-372942 | 12/1992 | Japan . |
| 5-49158 | 2/1993 | Japan . |

*Primary Examiner*—R. L. Moses

*Attorney, Agent, or Firm*—David G. Conlin; David S. Resnick; William J. Daley, Jr.

[57] ABSTRACT

When a CPU switches the power supply to a fusing lamp to OFF from ON state while an exposing lamp stays on, the CPU suspends a feedback phase control of the exposing lamp and carries out a phase control of the exposing lamp based on the phase control data pre-stored in a RAM for a predetermined period before and after the switching. The exposing lamp is hardly affected by the variance in voltage caused by the switching of the power supply state to the fusing lamp, and therefore can emit exposing light in a constant amount to form an image. Thus, it becomes possible to produce a satisfactory copy image with substantially no inconsistency in copy density.

14 Claims, 23 Drawing Sheets

27
23
FUSING LAMP
26
3
EXPOSING LAMP
25
28
24
THERMISTOR
EXPOSING LAMP DRIVING CIRCUIT
35
36
FUSING LAMP DRIVING CIRCUIT
32
EXPOSING LAMP MONITOR VOLTAGE GENERATING CIRCUIT
33
ZERO CROSSING POINT SIGNAL GENERATING CIRCUIT
34
FUSING TEMPERATURE DETECTING CIRCUIT
EXPOSING LAMP TRIGGER SIGNAL
38
ABNORMAL TRIGGER DETECTING CIRCUIT
37
REFERENCE VOLTAGE GENERATING CIRCUIT
C P U
30
R O M
29
31
R A M

2
START EXPOSING PROCESS
S14
S15
A PREDETERMINED PERIOD HAS PASSED SINCE THE STATE OF FUSING LAMP WAS CHANGED ?
NO
1
YES
S16
FUSING DEVICE'S TEMPERATURE IS ADEQUATE?
NO
S22
SWITCH FUSING LAMP FROM ON TO OFF?
NO
YES
S17
MEASURE EXPOSING LAMP'S VOLTAGE V CL
YES
A ← a
S23
S18
V CL > TARGET VALUE ?
YES
TURN OFF FUSING LAMP
S24
NO
S19
V CL < TARGET VALUE ?
YES
S21
NO
S20
A = A − x
A = A + x
3

2
START EXPOSING PROCESS
S14
S15
A PREDETERMINED PERIOD HAS PASSED SINCE THE STATE OF FUSING LAMP WAS CHANGED?
NO
2
YES
S16'
SWITCHING OF FUSING LAMP'S STATE NECESSARY?
YES
A ← a
S30
NO
S17
S31
MEASURE EXPOSING LAMP'S VOLTAGE V CL
TURN ON OR OFF FUSING LAMP
S18
V CL > TARGET VALUE ?
YES
NO
S19
V CL < TARGET VALUE ?
YES
S21
S20
NO
A = A − x
A = A + x
WRITE A INTO RAM (DATA a)
S29
3

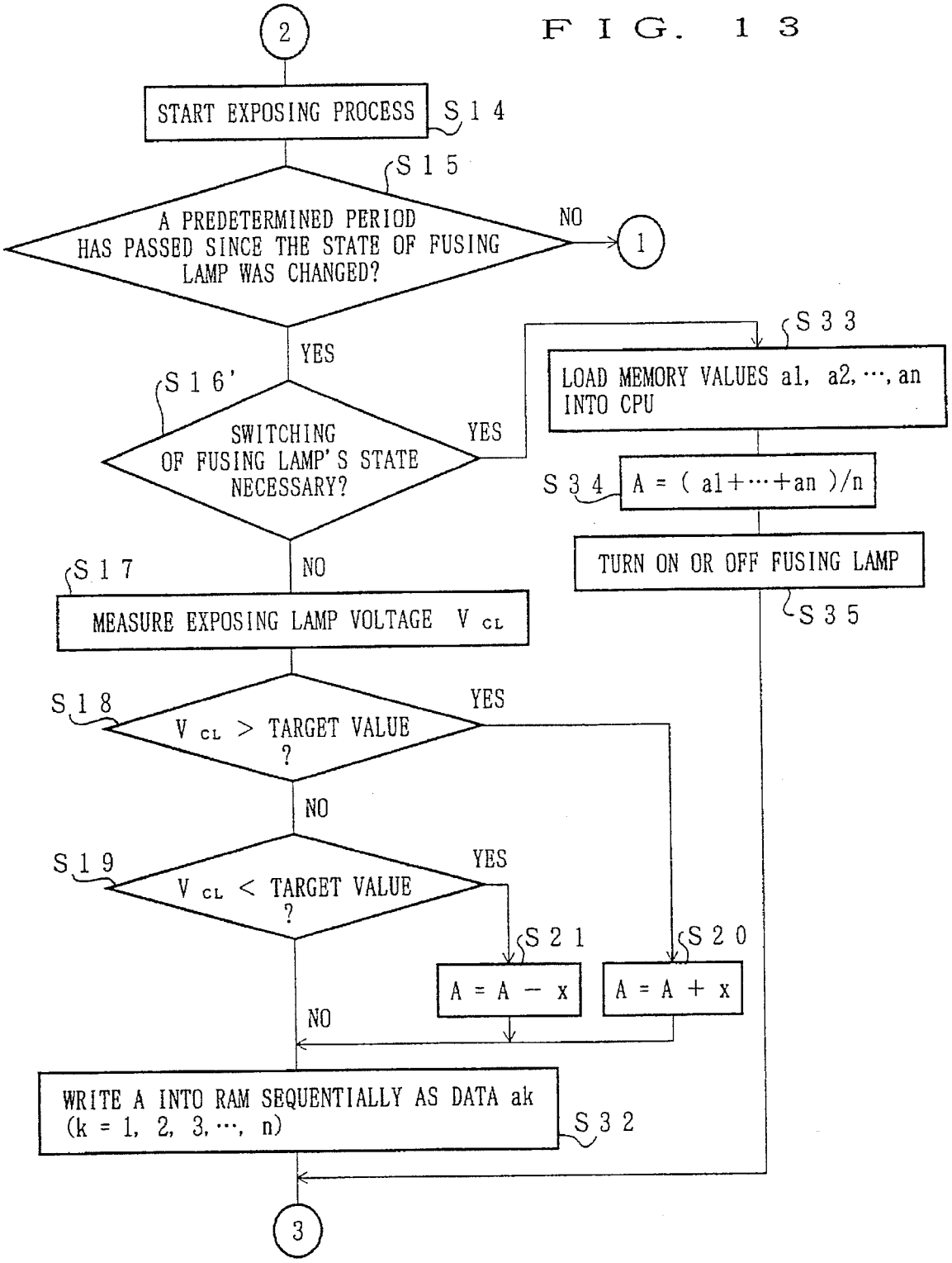
FIG. 13
2
START EXPOSING PROCESS
S14
S15
A PREDETERMINED PERIOD HAS PASSED SINCE THE STATE OF FUSING LAMP WAS CHANGED?
NO
1
YES
S16'
SWITCHING OF FUSING LAMP'S STATE NECESSARY?
YES
S33
LOAD MEMORY VALUES a1, a2, ···, an INTO CPU
S34
A = ( a1+···+an )/n
TURN ON OR OFF FUSING LAMP
S35
NO
S17
MEASURE EXPOSING LAMP VOLTAGE V CL
S18
V CL > TARGET VALUE ?
YES
NO
S19
V CL < TARGET VALUE ?
YES
S21
A = A − x
S20
A = A + x
NO
WRITE A INTO RAM SEQUENTIALLY AS DATA ak (k = 1, 2, 3, ···, n)
S32
3

2
START EXPOSING PROCESS
S14
S15
A PREDETERMINED PERIOD HAS PASSED SINCE THE STATE OF FUSING LAMP WAS CHANGED?
NO
5
YES
S16
FUSING DEVICE'S TEMPERATURE IS ADEQUATE?
NO
4
YES
MEASURE EXPOSING LAMP VOLTAGE V CL
S17
S18
V CL > TARGET VALUE ?
YES
NO
S19
V CL < TARGET VALUE ?
YES
S21
A = A − x
S20
A = A + x
NO
3

ELECTROPHOTOGRAPHIC APPARATUS

FIELD OF THE INVENTION

The present invention relates to electrophotographic apparatuses, such as a copying machine, provided with power consuming members including an exposing lamp, a fusing lamp, etc. which are connected to the same power source in parallel.

BACKGROUND OF THE INVENTION

In an electrophotographic apparatus, such as a copying machine, an exposing lamp and a fusing lamp are typical power consuming members connected to the same power source in parallel.

The exposing lamp irradiates a light beam onto a document to expose a photosensitive body by a reflected light beam to form an image. The exposing lamp is turned on and off each time a copy is made. The ON/OFF action of the exposing lamp is controlled, for example, by controlling the phase of an AC voltage from a power source to which the exposing lamp is connected. However, if the control device breaks and the exposing lamp stays on and continues to irradiate a light beam after the light-up period has passed, an excessive amount of light is irradiated onto the photosensitive body, thereby forming an unsatisfactory image. Also, the outer package of the copying machine may deform due to the heat generated by the exposing lamp, or at worst, smoking may occur from the outer package.

To prevent such incorrect light-up of the exposing lamp, for example, Japanese Laid-Open Patent Application No. 4-372942/1992 discloses a structure judging whether or not a copy lamp (exposing lamp) stays on erroneously based on a detection output of a document density sensor to stop the power supply to such an erroneously lit-up copy lamp.

An amount of light of the exposing lamp is adjusted, for example, by controlling the phase angle using a reference level signal generated based on a PWM (Pulse Width Modulation) signal from a CPU. However, if the CPU has a runaway or the like and continues to output the PWM signal, the reference level signal stays at the maximum level (the reference level is held at the maximum level) and hence the exposing lamp stays on. In such a case, the heat generated by the exposing lamp may deform the outer package, or cause smoke from the outer package at worst.

To prevent such continuous light-up of the exposing lamp caused by a runaway of the CPU, Japanese Laid-Open Patent Application No. 5-49158/1993, for example, discloses a structure, in which an ON state period of the PWM signal generated by the CPU is measured by a timer, and a time-up signal is outputted to a light-up circuit of the exposing lamp after a predetermined period to forcibly stop the power supply to the exposing lamp.

On the other hand, the fusing lamp raises the temperature of a heat roller provided in a fusing device. The temperature of the heat roller is stabilized at a predetermined level by, for example, turning on and off the fusing lamp, which is carried out based on a detection output of a temperature sensor provided near the heat roller.

The exposing lamp and fusing lamp are connected to the same power source in parallel and consume relatively a large amount of power compared with the other power consuming members in the electrophotographic apparatus. Thus, the power source voltage varies depending on the ON/OFF state of either the exposing lamp or fusing lamp, which changes the voltage applied to the other. More precisely, when the fusing lamp is turned on or off while the exposing lamp stays on, each ON/OFF switching action of the fusing lamp changes a voltage supplied to the exposing lamp, thereby making an amount of irradiation light uneven. Accordingly, as shown in FIG. 24, a resulting image has inconsistencies in monochromic density, namely, inconsistencies in copy density, in a portion copied at the moment the ON/OFF state of the fusing lamp is switched, thereby degrading the image quality.

To solve the above problem, Japanese Utility Model Gazette No. 58-53552(1983) discloses a temperature control device for the fusing lamp, which inhibits the fusing lamp's ON/OFF control while the exposing lamp is in the ON state (stays on), and allows the same while the exposing lamp is in the OFF state (goes off). According to this structure, variance in voltage caused by the fusing lamp's ON/OFF switching during the exposing process can be prevented, thereby making it possible to produce a satisfactory image without any inconsistency in copy density.

Incidentally, to realize satisfactory fusing, the temperature of the heat roller of the fusing device must be maintained in a predetermined range. Temperatures out of the predetermined range causes defective fusing (low temperature offset when the temperature is below the lower limit of the predetermined range, high temperature offset when the temperature is above the upper limit of the predetermined range). A thin heat roller of about 1 mm thick having a small heat capacity is used in general to facilitate the temperature control.

However, if the ON/OFF control of the fusing lamp is inhibited while the exposing lamp stays on as is disclosed in the above Japanese Utility Model Gazette No. 58-53552 (1983), and in particular, if the heat roller provided in the exposing lamp is thin and has a small heat capacity, the temperature of the fusing device drops below the predetermined range (the range in which satisfactory fusing can be realized) when the fusing lamp is in the OFF state while the exposing lamp stays on, thereby possibly causing the low temperature offset. On the other hand, the temperature of the fusing device rises above the predetermined temperature range when the fusing lamp is in the ON state while the exposing lamp stays on, thereby possibly causing high temperature offset.

Therefore, although variance in voltage of the exposing lamp can be curbed and uneven exposure can be eliminated by inhibiting the fusing lamp's ON/OFF control while the exposing lamp stays on, there readily occurs defective fusing, such as low temperature offset or high temperature offset. Accordingly, the above structure presents a problem that the quality of a resulting image is degraded.

SUMMARY OF THE INVENTION

It is therefore an object of the present invention to provide an electrophotographic apparatus which can upgrade the quality of a resulting image by (1) eliminating uneven exposure by stabilizing an amount of irradiation of the exposing lamp, and (2) eliminating defective fusing by controlling the temperature of the fusing lamp accurately.

To fulfil the above object, a first electrophotographic apparatus in accordance with the present invention is provided with:

- an exposing light source for irradiating a light beam onto a document upon receipt of power supply;
- a fusing heat source for fusing a non-fused image on a sheet onto the sheet upon receipt of power supply;
- a power source for supplying power to the exposing light source and the fusing heat source, the exposing light source and the fusing heat source being connected to the power source in parallel;

a voltage variance detecting device for detecting variance in voltage of the exposing light source;

an exposing amount control device for controlling a phase of a voltage supplied to the exposing light source based on a feedback result of the variance in voltage detected by the voltage variance detecting device to adjust an amount of light of the exposing light source to a predetermined value;

a temperature detecting device for detecting a temperature of the fusing heat source;

a fusing temperature control device for stabilizing a temperature of the fusing heat source at a predetermined value by switching an ON state and an OFF state based on a detection result of the temperature detecting device, power being supplied to the fusing heat source from the power source in the ON state while no power being supplied in the OFF state; and a phase control data storage device for storing phase control data of the exposing light source, wherein, when the fusing temperature control device switches the power supply to the fusing heat source to OFF from ON state while the exposing light source stays on, the exposing amount control device suspends the phase control based on the feedback and carries out a phase control based on the phase control data stored in the phase control data storage device within a predetermined period before and after the switching.

According to the above structure, when the power supply to the fusing heat source is switched to OFF from ON state while the exposing light source stays on, the phase control of the exposing light source is carried out based on the phase control data for the exposing light source stored in the storage device. Thus, the exposing light source, which is connected to the power source in parallel with the fusing heat source, is hardly affected while a voltage of the power source varies in response to the switching of the power supply state to the fusing heat source to OFF from ON state. Thus, the exposing light source can expose light of a constant amount, thereby making it possible to produce a satisfactory image having substantially no inconsistencies in density with enhanced quality.

A second electrophotographic apparatus having the same structure as the first electrophotographic apparatus is characterized in that the phase control data storage device stores, as the phase control data, data generated based on data related to variance in voltage of the exposing light source detected before the power supply state to the fusing heat source is switched.

According to the above structure, the phase control data storage device stores, as the phase control data, data generated based on data related to variance in voltage of the exposing light source detected before the power supply state to the fusing heat source is switched. Thus, the phase control of the exposing light source can be carried out based on the variance in voltage of the exposing light source that was used actually. Accordingly, the exposing light source is hardly affected by the variance in voltage and can expose light in a constant amount, thereby making it possible to produce a satisfactory image having substantially no inconsistencies in density with enhanced quality.

A third electrophotographic apparatus is provided with:

an exposing light source for irradiating a light beam onto a document upon receipt of power supply;

a fusing heat source for fusing a non-fused image on a sheet onto the sheet upon receipt of power source;

a power source for supplying power to the exposing light source and the fusing heat source, the exposing light source and the fusing heat source being connected to the power source in parallel;

a voltage variance detecting device for detecting variance in voltage of the exposing light source;

an exposing amount control device for determining a gain of a phase using a feedback amount based the variance in voltage detected by the voltage variance detecting device, and for adjusting an amount of light of the exposing light source to a predetermined value by increasing a phase of a voltage supplied to the exposing light source by the gain;

a temperature detecting device for detecting a temperature of the fusing heat source;

a fusing temperature control device for stabilizing a temperature of the fusing heat source at a predetermined value by switching an ON state and an OFF state based on a detection result of the temperature detecting device, power being supplied to the fusing heat source from the power source in the ON state while no power being supplied in the OFF state; and a phase control data storage device for storing phase control data of the exposing light source, wherein, when the fusing temperature control device switches the power supply to the fusing heat source to OFF from ON state while the exposing light source stays on, the exposing amount control device makes, for a predetermined period, the gain of feedback phase control smaller than a gain when the fusing temperature control device does not switch the power supply state of the fusing heat source while the exposing light source stays on.

According to the above structure, when the power supply to the fusing heat source is switched to OFF from ON state while the exposing light source stays on, the gain of the feedback phase control is made smaller than a predetermined value in response to variance in voltage of the exposing light source. Thus, an excessive response to the variance in voltage of the exposing light source can be prevented, and as a result, a voltage can be supplied to the exposing light source in a stable manner. Since a constant voltage can be applied to the exposing light source, it becomes possible to produce a satisfactory image without any inconsistency in copy density of a resulting image at a point copied at the moment when the ON/OFF state of the fusing heat source was switched.

A fourth electrophotographic apparatus having the structure of the first, second or third structure is characterized in that it is further provided with a fusing temperature range storage device for storing a temperature range realizing satisfactory fusing of the fusing heat source, wherein the fusing temperature control device controls power supply from the power source in such a manner that:

(1) when the exposing light source is in the OFF state and the fusing heat source is in a pre-fusing state, a temperature of the fusing heat source rises to around an upper limit of the temperature range realizing satisfactory fusing stored in the fusing temperature range storage device; and (2) when the exposing light source is in the ON state, a power supply to the fusing heat source stops.

According to the above structure, even if no power is supplied to the fusing heat source while the exposing light source stays on, the temperature of the fusing heat source is raised to around the upper limit of the temperature range realizing satisfactory fusing stored in the fusing temperature range storage device. Thus, the temperature of the fusing heat source never drops below the lower limit of the temperature range realizing satisfactory fusing. As a consequence, when the ON/OFF control of the power supply to the fusing heat source is inhibited while the exposing light source stays on, an image can be fused in a satisfactory manner. In addition, since the temperature of the fusing heat source is maintained within the temperature range realizing satisfactory fusing, the variance in voltage does not give adverse effects to the exposing light source even if the temperature of the fusing heat source is not controlled while the exposing lamp stays on. Thus, it becomes possible to eliminate inconsistencies in copy density caused when the voltage of the exposing light source varies as the power supply state to the fusing heat source is switched to OFF from ON state while a copy is being made. Moreover, an image can be fused in a satisfactory manner and a satisfactory image can be produced.

For a fuller understanding of the nature and advantages of the invention, reference should be made to the ensuing detailed description taken in conjunction with the accompanying drawings.

BRIEF DESCRIPTION OF THE DRAWINGS

FIG. 13 is a flowchart detailing another example phase control of the exposing lamp in the above embodiment;

DETAILED DESCRIPTION OF THE PREFERRED EMBODIMENTS

[First Embodiment]

Referring to FIGS. 1 through 11, the following description will describe an example embodiment of the present invention. Note that, a copying machine representing an electrophotographic apparatus and a control device in each of the following embodiments are of the same structure, and the description of which is given in the first embodiment only.

Figure 4:
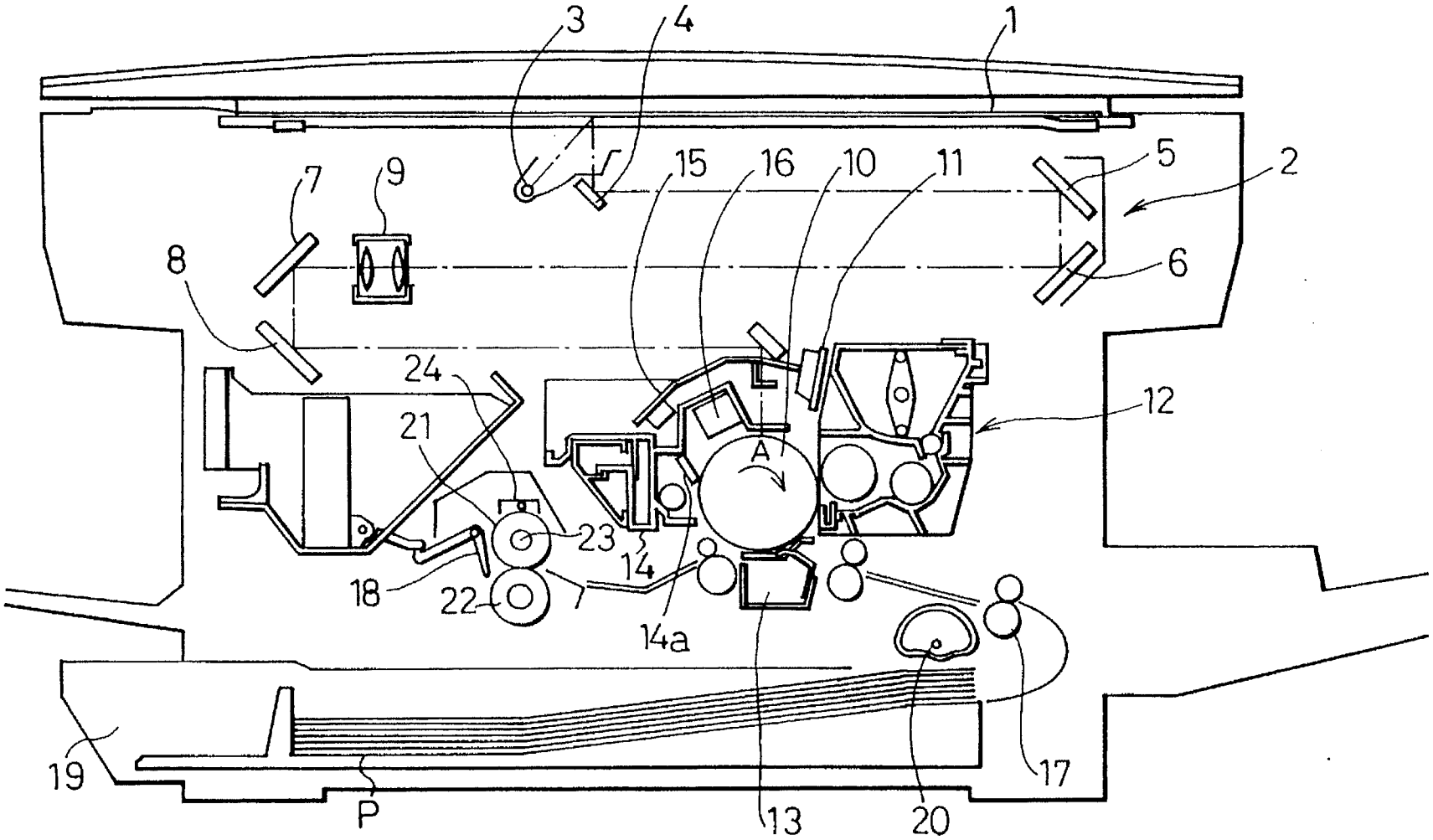
FIG. 4 is a schematic view showing an example structure of the copying machine of FIG. 1.

As shown in FIG. 4, a copying machine, an example of an electrophotographic apparatus in accordance with the present embodiment, includes a document table 1 made of, for example, transparent glass, on an upper surface. An exposing system 2 is provided below the document table 1. The exposing system 2 includes (1) an exposing light source (hereinafter, referred to as an exposing lamp) 3, which is in effect a halogen lamp, for irradiating a light beam onto a document placed on the document table 1, (2) a series of reflecting mirrors 4, 5, 6, 7, and 8 for guiding light reflected from the document to an incident point A on a photosensitive body 10 provided below the exposing system 2 as is indicated by an alternative long and short dash line in the drawing, and (3) an image forming lens 9 provided in a light path of the above reflecting mirrors.

The photosensitive body 10 is a drum driven to rotate in a direction indicated by an arrow. Provided sequentially around the photosensitive body 10 are: a blank lamp unit 11 for erasing extra charges on the surface of the photosensitive body 10 in the rotational direction thereof from the incident point A to form void or the like when making a copy, a developing device 12 for developing an image formed on the photosensitive body 10 into a visible image, a transfer charger 13 for transferring a toner image on the photosensitive body 10 onto a paper, a cleaning device 14 having a cleaning blade **14*a* for removing residual toner on the surface of the photosensitive body 10, an erasing lamp 15 for erasing post-cleaning residual charges on the photosensitive body 10, and a main charger 16 for charging the photosensitive body 10** to a predetermined potential.

A paper carrying roller 17 for carrying a transfer paper P to the transfer charger 13 is provided in the upstream side of the photosensitive body 10 in a direction in which the transfer paper P is carried forward. A fusing device 18 for fusing a toner image transferred onto the transfer paper P onto the same is provided in the downstream side of the photosensitive body 10 in the direction in which the transfer paper P is carried forward.

Further, a paper cassette 19 containing a set of transfer papers P is provided below the photosensitive body 10. A transfer paper P is sent to the paper carrying roller 17 as a paper feeding roller 20 provided above the paper cassette 19 rotates. Then, a toner image formed on the surface of the photosensitive body 10 by the transfer charger 13 is transferred onto the transfer paper P and fused thereon by the fusing device 18, thereby producing a copy image.

Figure 5:
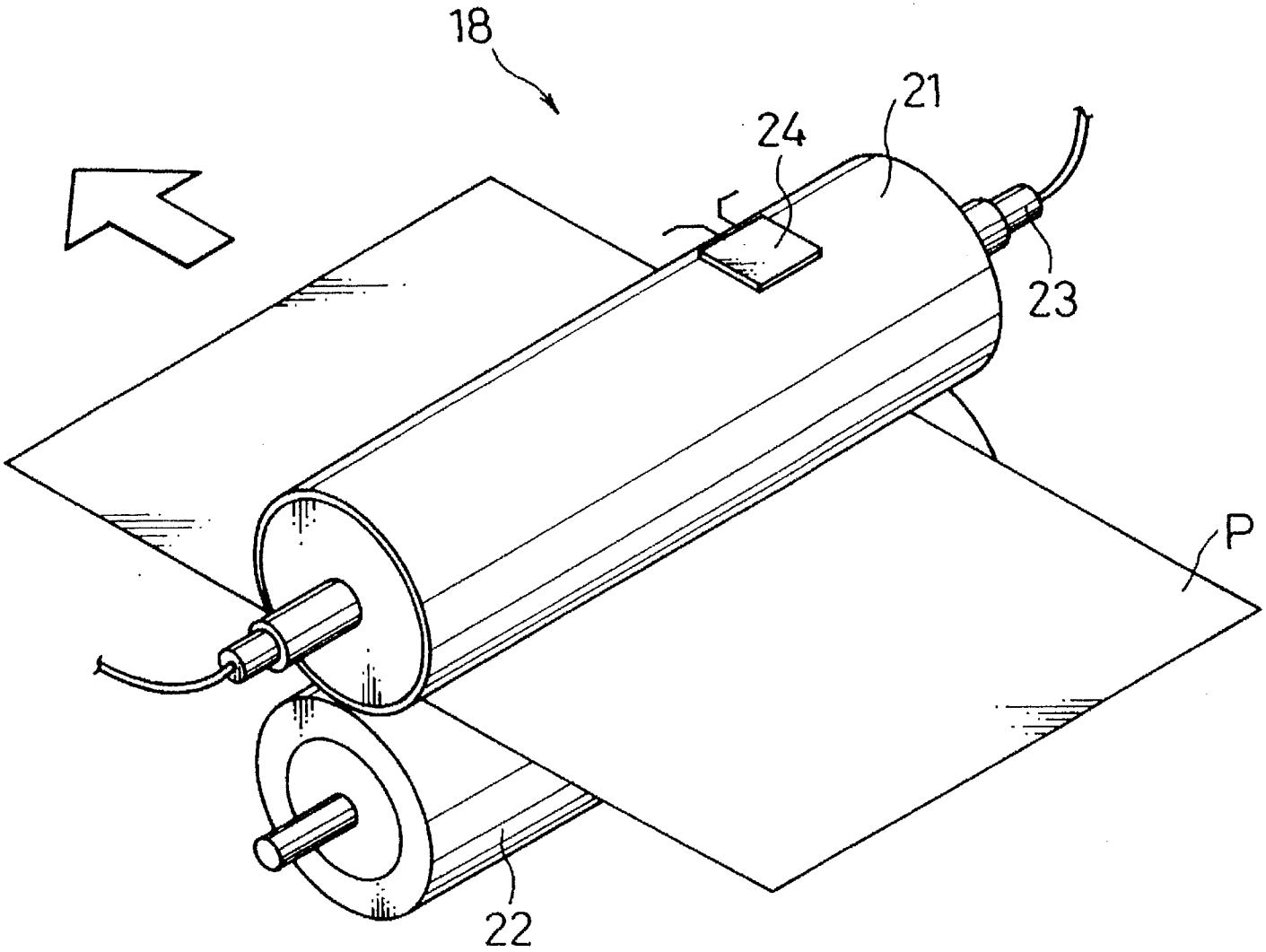
FIG. 5 is a schematic view showing an example structure of a fusing device provided in the copying machine of FIG. 4.

As shown in FIG. 5, the fusing device 18 includes upper and lower heat rollers 21 and 22 for heating the toner image on the transfer paper P to fuse the toner image to the transfer paper P. The upper heat roller 21 is an aluminium cylindrical drum of about 1 mm thick, and a fusing halogen lamp (hereinafter, referred to as a fusing lamp) 23 serving as a fusing heat source is provided inside thereof. A thermistor 24 is provided above the upper heat roller 21 as temperature detecting means for detecting the temperature of the upper heat roller 21. The heat roller 21 is controlled to maintain a temperature within a predetermined range based on the detection result of the thermistor 24.

Thus, the fusing device 18 heat-fuses a toner image onto the transfer paper P by melting toner while letting pass the transfer paper P carrying the toner image through a section between the upper heat roller 21 and lower heat roller 22.

Figure 1:
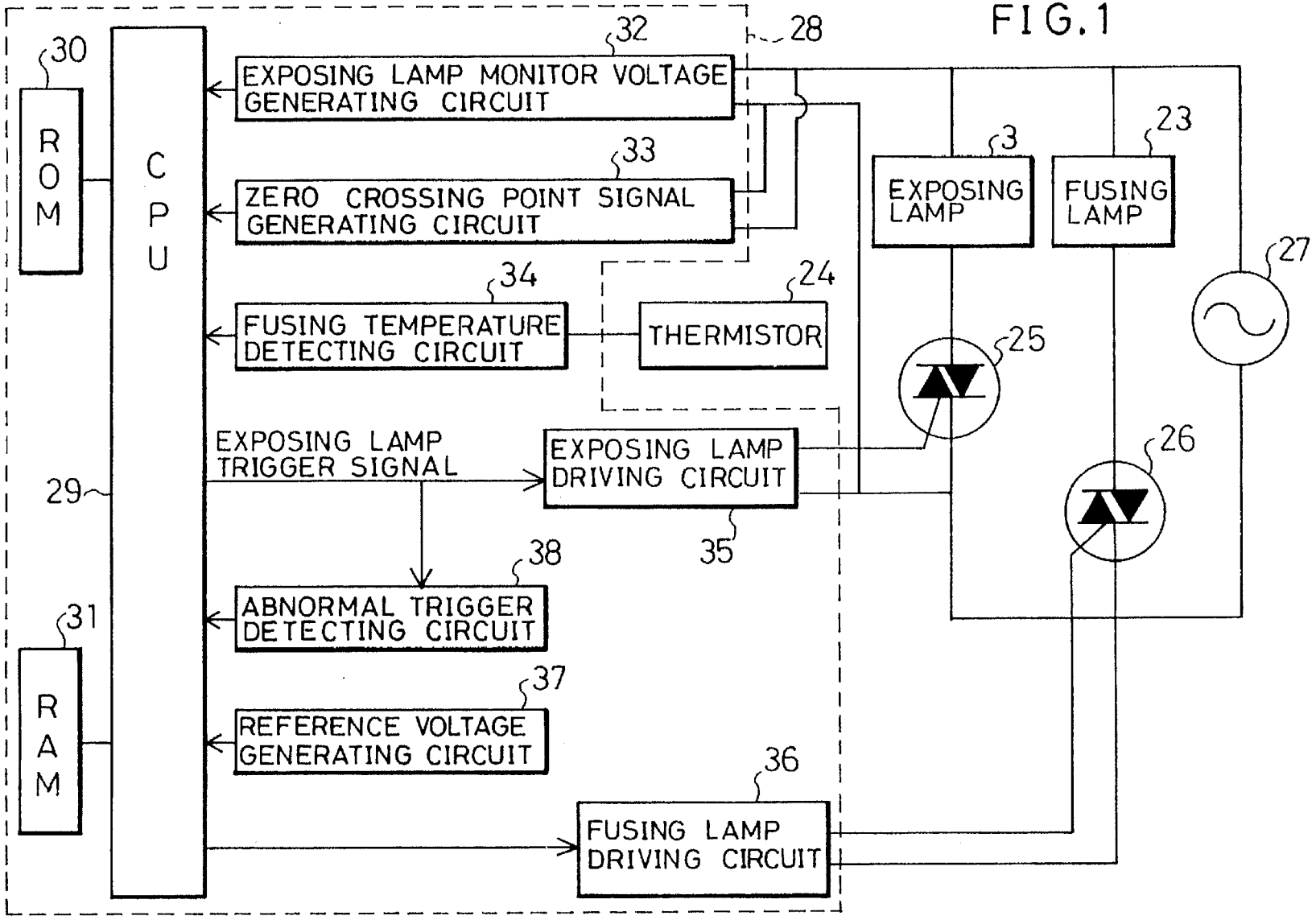
FIG. 1 is a control block diagram of a copying machine representing an electrophotographic apparatus in accordance with an example embodiment of the present invention.

As shown in FIG. 1, the exposing lamp 3 and fusing lamp 23 of the present copying machine are connected in parallel to an AC power source 27 serving as an applied voltage supplying source through switches 25 and 26, respectively. To be more specific, the exposing lamp 3 is turned on or off by the switch 25 while the fusing lamp 23 is turned on or off by the switch 26.

Figure 7:
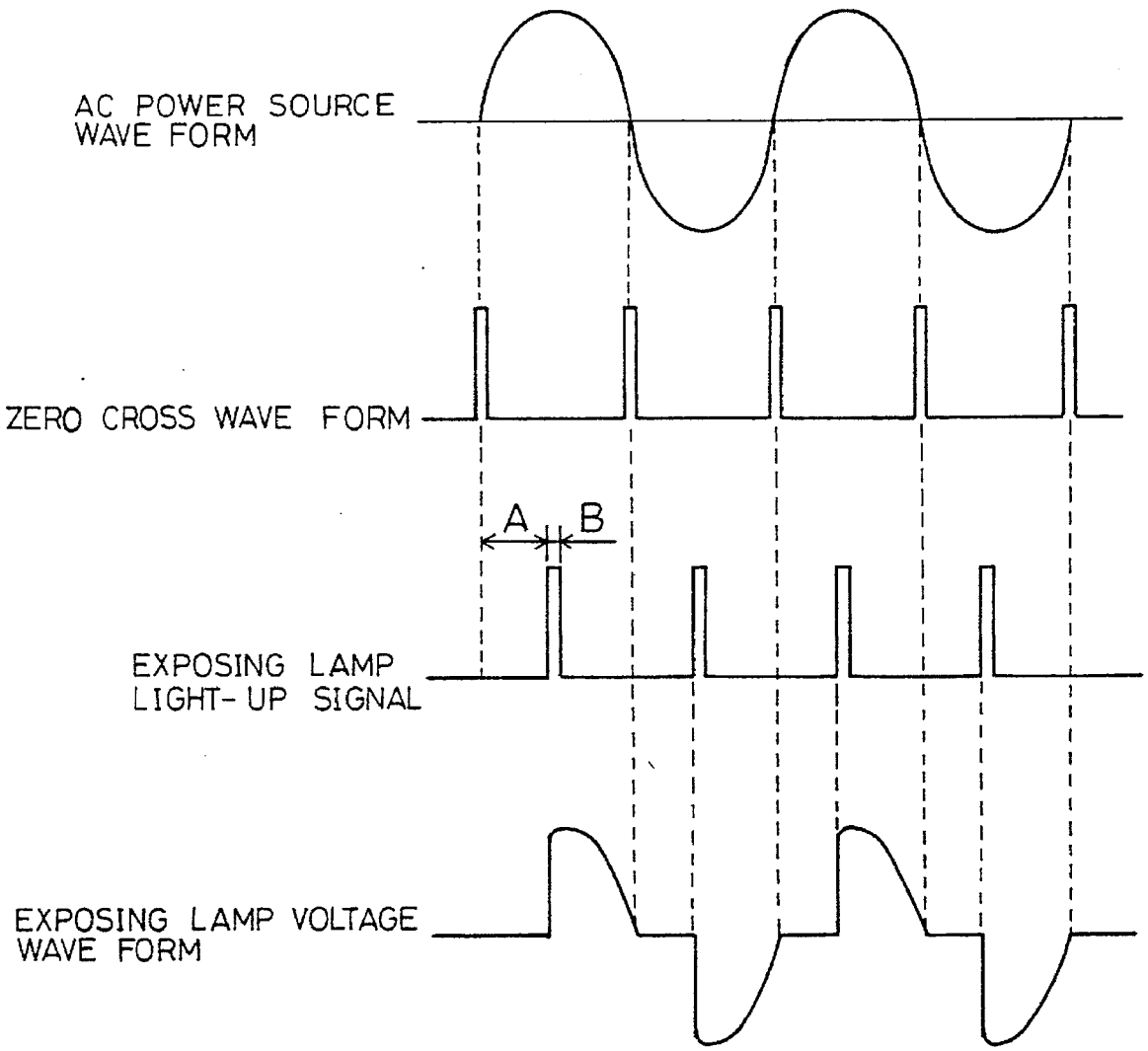
FIG. 7 is a view showing wave forms of the AC power source provided to the copying machine of FIG. 4, a zero cross signal, an exposing lamp light-up signal, and an exposing lamp voltage.

The switches 25 and 26 are bidirectional thyristors (generally known as TRIAC) or the like. The TRIAC generally comes on upon receipt of an exposing lamp light-up signal of some hundreds microseconds and stays on after the exposing lamp light-up signal is turned off until the wave form of a voltage from the AC power source 27 to the exposing lamp 3 reaches zero volt. For example, a half of the AC wave form is 10 msec. in case of 50 Hz and 8.33 msec. in case of 60 Hz, and the exposing lamp 3 stays on only for some hundreds microseconds (500 sec in general) during the above half of the AC wave form. The exposing lamp light-up signal, the wave form of the AC power source, and the wave form of the exposing lamp's voltage are shown in FIG. 7. FIG. 7 reveals that only if the exposing lamp light-up signal from the switch 25 is turned on for a predetermined time B during the half of a voltage wave form of the AC power source 27, a voltage is applied to the exposing lamp 3 continuously until the voltage wave form of the AC voltage 27 drops to substantially zero even after the exposing lamp light-up signal was turned off.

The AC power source 27 is an external power source (plug socket or the like) of the copying machine main body having a sufficient capacity to operate the copying machine. Note that, however, the AC power source 27 is connected to the copying machine by way of a plug socket through a long transmission line after a voltage is transformed by a transformer, thus, when a current flows through the transmission line, the voltage drops by some volts due to the impedance of the transmission line.

The copying machine of the present embodiment includes a power supply control device 28 for controlling power supplied to the exposing lamp 3 and fusing lamp 23 from the AC power source 27. The power source supply control device 28 includes a CPU (exposing amount control means and fusing temperature control means) 29 serving as main control means, a ROM 30 for storing control programs of the copying machine, and a RAM 31 serving as not only a work area when executing a program but also storage means for storing phase control data or the like for controlling an applied voltage to the exposing lamp 3.

The CPU 29 is connected to an exposing lamp monitor voltage generating circuit (voltage variance detecting means) 32, a zero cross point signal generating circuit 33, a fusing temperature detecting circuit 34, an exposing lamp driving circuit 35, a fusing lamp driving circuit 36, a reference voltage generating circuit 37, and an abnormal trigger detecting circuit 38.

The exposing lamp monitor voltage generating circuit 32 takes in a voltage from the AC power source 27 near the exposing lamp 3 to measure an applied voltage to the same, and converts the applied voltage into an adequate one to output a resulting signal (analogue voltage) to the CPU 29.

The zero cross point signal generating circuit 33 detects a zero cross point of an AC wave form of the AC power source 27 to generate an adequate voltage, and outputs a resulting signal to the CPU 29.

The fusing temperature detecting circuit 34 detects the temperature of the fusing device 18 by means of the thermistor 24, and outputs an analogue signal based on the detected temperature to the CPU 29.

The exposing lamp driving circuit 35 turns on or off the switch 25 serving as a driving switch of the exposing lamp 3 using an exposing lamp trigger signal (hereinafter, referred to as the trigger signal) outputted from the CPU 29. Here, the switch 25 comes on when the trigger signal is HIGH to turn on the exposing lamp 3, while the switch 25 goes off when the trigger signal is LOW to turn off the exposing lamp 3.

The fusing lamp driving circuit 36 turns on or off the switch 26 serving as a driving switch of the fusing lamp 23 using an ON/OFF signal outputted from the CPU 29 in response to an output signal from the fusing temperature detecting circuit 34 based on, for example, the detected temperature of the upper heat roller 21.

The reference voltage generating circuit 37 outputs a voltage to the CPU 29, which is used as a reference with respect to various kinds of output signals from the CPU 29.

Figure 2:
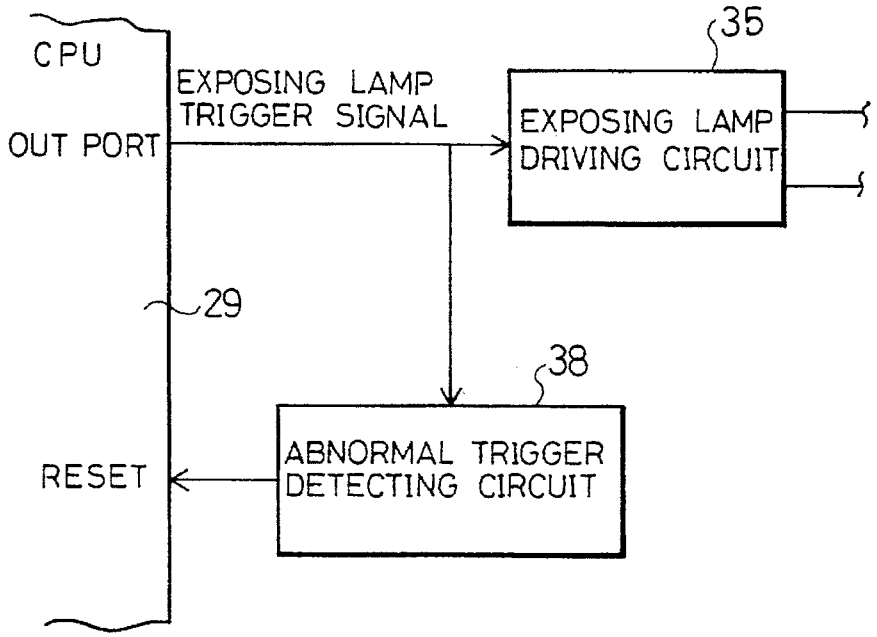
FIG. 2 is a view explaining the connection state of an exposing lamp monitor voltage generating circuit and an abnormal trigger detecting circuit to a CPU within a control device of the copying machine of FIG. 1.

The abnormal trigger detecting circuit 38 detects abnormal trigger signal and outputs a detection signal to the CPU 29. More precisely, as shown in FIG. 2, the trigger abnormal detecting circuit 38 is connected to two terminals of the CPU 29: an OUT PORT terminal serving as a terminal for the exposing lamp light-up signal and a RESET terminal. For example, a trigger signal remaining HIGH (ON state) suggests a possible runaway of the CPU 29. Thus, the abnormal trigger detecting circuit 38 is activated to output a signal that resets the CPU 29 to the RESET terminal of the CPU 29.

Figure 3:
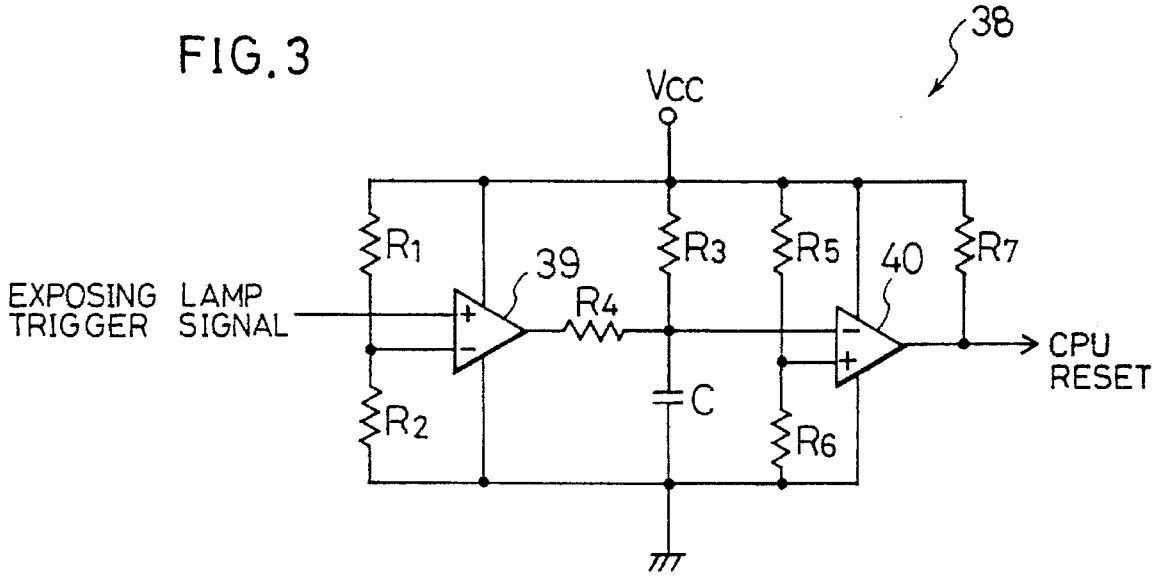
FIG. 3 is a schematic circuit diagram showing an example of the abnormal trigger detecting circuit of FIG. 2.

The abnormal trigger detecting circuit 38 comprises, for example, comparators 39 and 40, resistors R1 through R7, and a condenser C as shown in FIG. 3.

In other words, in the abnormal trigger detecting circuit 38, a trigger signal is inputted into a positive terminal of the comparator 39, while a voltage divided by the resistors R1 and R2 is inputted into a negative terminal of the comparator 39. Accordingly, a HIGH/LOW signal identical with the trigger signal is re-generated by the comparator 39. If the output from the comparator 39 exhibits HIGH (the exposing lamp light-up signal is turned on), the abnormal trigger detecting circuit 38 is charged by the resistor R3 and condenser C. On the other hand, if the output from the comparator 39 exhibits LOW (the exposing lamp light-up signal is turned off), the abnormal trigger detecting circuit 38 is discharged by the resistor 4 and condenser C.

Likewise, a voltage divided by the resistors R5 and R6 is inputted into a positive terminal of the comparator 40 while either the charge or discharge voltage from the resistor R3 and condenser C, or the resistor R4 and condenser C is inputted into a negative terminal of the comparator 40. The output of the comparator 40 is reversed when the voltage divided by the resistors R5 and R6 becomes lower than the charge or discharge voltage from the resistors R3 and condenser C, or the resistors R4 and condenser C, and a resulting signal is outputted to the RESET terminal of the CPU 29 to reset the CPU 29.

On the other hand, like the abnormal trigger detecting circuit 38, the exposing lamp driving circuit 35 is connected to the OUT PORT terminal of the CPU 29 as shown in FIG. 2, and a duty ratio (HIGH/LOW (ON/OFF)) of a trigger signal is switched by a processor of the CPU 29 each time the state of the exposing lamp 3 is switched. That is to say, the exposing lamp 3 is turned on based on the duty ratio. Assume that the CPU 29 operates normally, then a trigger signal is outputted to the exposing lamp driving circuit 35 to turn on the exposing lamp 3 at a duty ratio (HIGH/(HIGH+LOW)) of, for example, 0.5/8.33=0.06 (6%).

However, if the CPU 29 does not operate normally, that is to say, when the CPU 29 runs away, the trigger signal often remains HIGH or LOW because the trigger signal is outputted to the exposing lamp driving circuit 35 through the OUT PORT terminal of the CPU 29 as previously explained. When the trigger signal remains LOW, there will be no danger because the exposing lamp 3 is not turned on. Whereas when the trigger signal remains HIGH, the exposing lamp 3 stays on, thereby increasing the possibility of danger, such as ignition and smokes.

However, the abnormal trigger detecting circuit 38 is provided in the present embodiment. The abnormal trigger detecting circuit 38 detects a runaway or malfunction of the CPU 29 using a large ratio between the duties when the exposing lamp 3 is turned on normally and when the CPU 29 has a runaway or malfunction, and resets the CPU 29 in case of a runaway or malfunction, thereby enabling the CPU 29 to operate normally while avoiding possible danger.

As has been explained, the OUT PORT terminal of the CPU 29 is used instead of the PWM terminal in the present embodiment. Thus, a sufficiently large S/N ratio (duty ratio, herein) between the normal and abnormal states of the CPU 29 can be set using a large ratio between the duties when the exposing lamp 3 is turned on normally and when the CPU 29 has a runaway or malfunction, that is to say, using a software program. As a result, a runaway of the CPU 29 can be clearly distinguished from a normal state. Thus, the runaway of the CPU 29 can be detected more precisely and the CPU 29 can be reset quickly when a runaway is detected, thereby making it possible to prevent ignition, smokes or the like caused by the heat from the exposing lamp 3.

Figure 6:
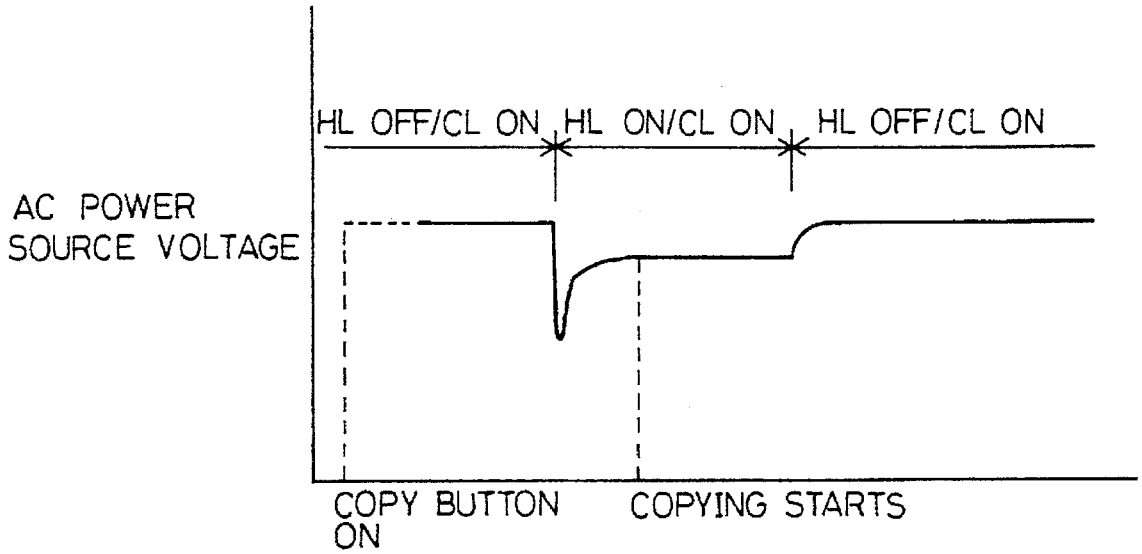
FIG. 6 is a view showing a voltage of an AC power source provided to the copying machine of FIG. 4.

Of all the power consuming members of the above-structured copying machine, the exposing lamp 3 and fusing lamp 23 consume a relatively large amount of power. Thus, the voltage of the AC power source 27 varies in response to the ON/OFF switching action of the exposing lamp 3 and fusing lamp 23. This is because the voltage drops due to the impedance of the transmission line of the AC power source 27 as previously mentioned. In other words, as shown in FIG. 6, the voltage of the AC power source 27 is stabilized at a specific value for a period since a copy button of the copying machine was turned on until a copying operation starts, keeping the fusing lamp (HL) 23 turned off and the exposing lamp (CL) 3 turned on. When the fusing lamp 23 is switched to ON from OFF state while the exposing lamp 3 stays on just before the copying operation starts, the voltage of the AC voltage 27 drops abruptly and stabilizes gradually. Subsequently, when the fusing lamp 23 is switched to OFF from ON state while the exposing lamp 3 stays on after the copying operation starts, the voltage of the AC power source 27 rises slightly and stabilizes at a level equal to the level just when the copy button of the copying machine was turned on.

The voltage of the AC power source 27 varies in response to the ON/OFF switching of the fusing lamp 23 as has been explained, and so does a voltage applied to the exposing lamp 3. Accordingly, an amount of light of the exposing lamp 3 varies as well. To stabilize an amount of light of the exposing lamp 3, the power supply from the AC power source 27 must be controlled, that is to say, a phase on control of the exposing lamp 3 must be carried out, to eliminate any adverse effect from variance in voltage of the fusing roller 23.

In the following, the phase on control of the exposing lamp 3 of the present embodiment will be explained with reference to FIGS. 8 through 10. Note that the above control represents a flowchart that begins by turning on the exposing lamp 3 and ends by completing the feeding of the optical system, namely, an exposing process.

Figure 8:
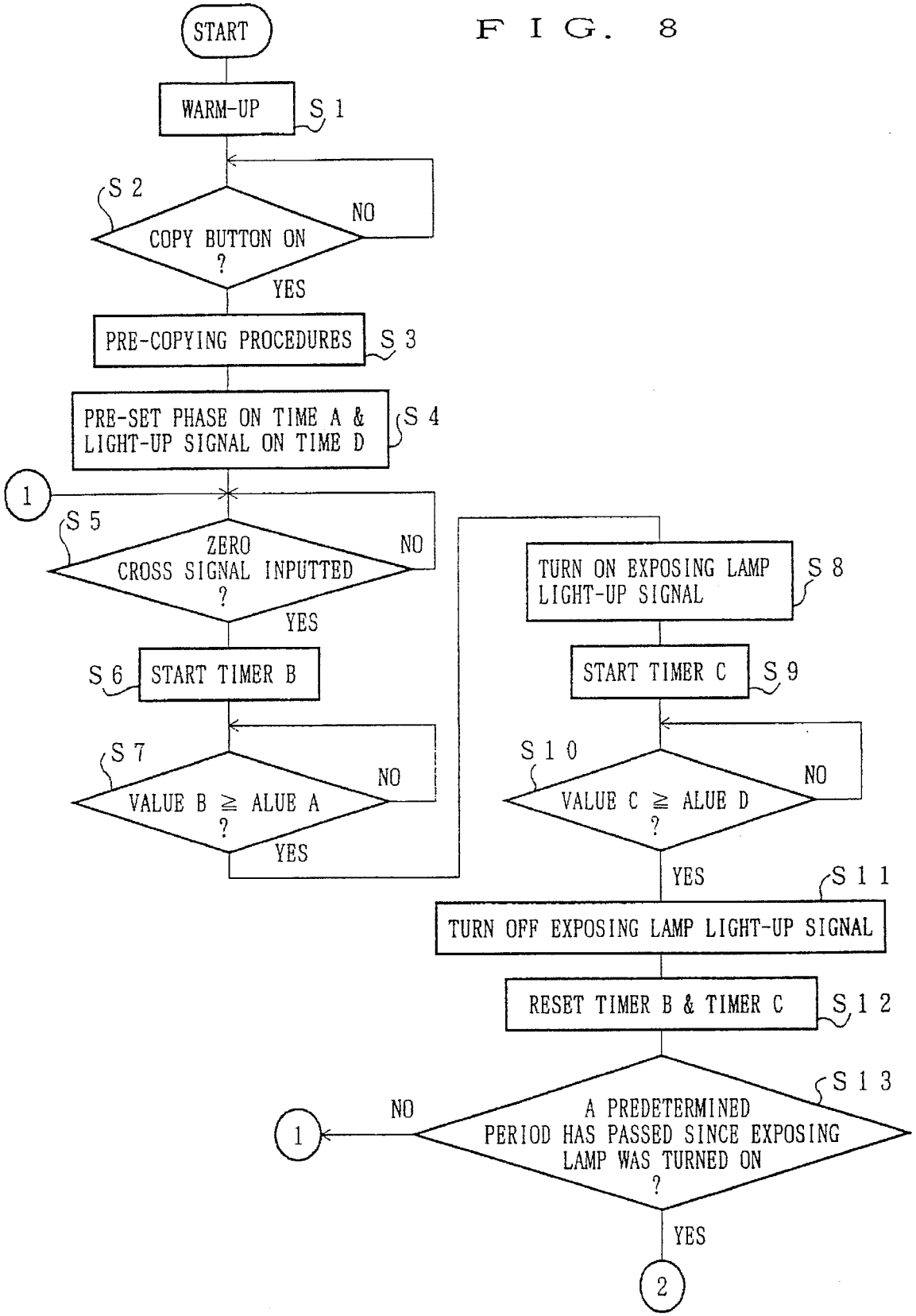
FIG. 8 is a flowchart detailing an example phase control of the exposing lamp.

To being with, as shown in FIG. 8, when a power of the copying machine is turned on, the CPU 29 is activated to start the warm-up (S1) and take necessary procedures to start a copying operation and enters a ready state. At the same time, the ON/OFF control of the fusing lamp 23 is carried out to control the temperature of the fusing device 18 (which is omitted in the flowchart).

Next, the user presses a copy button on a manipulation panel (not shown) to turn it on to make a copy (S2). Accordingly, the CPU 29 carries out pre-copying procedures, such as paper jam check and display processing (S3), and pre-sets a phase on time A for the exposing lamp 3 and the light-up signal on time D for the exposing lamp 3 to their respective predetermined values pre-stored in the RAM 31 (S4). Next, the CPU 29 waits for a zero signal from the zero cross signal generating circuit 33 to start the exposing process (S5). Upon input of the zero cross signal, a timer B provided to the CPU 29 starts to measure a time since the zero cross signal is inputted (S6).

Next, when the timer B reaches a pre-set value, which is expressed as: value B≧value A (S7), an exposing lamp light-up signal (TRIAC on signal) is outputted from the switch 25 which controls the ON/OFF switching of the exposing lamp 3 (S8). As has been explained, the TRIAC forming the switch 25 comes on upon receipt of the exposing lamp light-up signal of some hundreds microseconds and stays on until a voltage wave form reaches the zero volt even after the exposing lamp light-up signal is turned off. Thus, a timer C provided to the CPU 29 starts to operate after the exposing lamp light-up signal is turned on (S9), and when the value of the timer C reaches a pre-set value D of the exposing lamp light-up signal, which is expressed as value C≧value D (S10), the exposing lamp light-up signal is turned off (Sll). The pre-set value D of the timer C is equal to the time during which the TRIAC stays on upon receipt of the exposing lamp light-up signal, namely, some hundreds microseconds.

The wave form of the AC power source, zero cross wave form, wave form of the exposing lamp light-up signal, and wave form of exposing lamp voltage are shown in FIG. 7.

Then, the timers B and C are reset (S12).

Next, the CPU 29 checks whether a predetermined time (a time necessary to stabilize the light-up state of the exposing lamp 3) has passed or not since the exposing lamp 3 was turned on, that is, since the power of the copying machine is turned on (S13). When the predetermined time is not judged to have passed, the CPU 29 judges it is immediately after the exposing lamp 3 is turned on, namely, a period during which the light-up state of the exposing lamp 3 is not stabilized. Since the exposing lamp 3 must be turned on again for the pre-set phase on time A until the light-up state thereof stabilizes, the CPU 29 proceeds to S5. This is because a time ranging from tens to some hundreds milliseconds is necessary to stabilize the light-up state of the exposing lamp 3.

Figure 9:
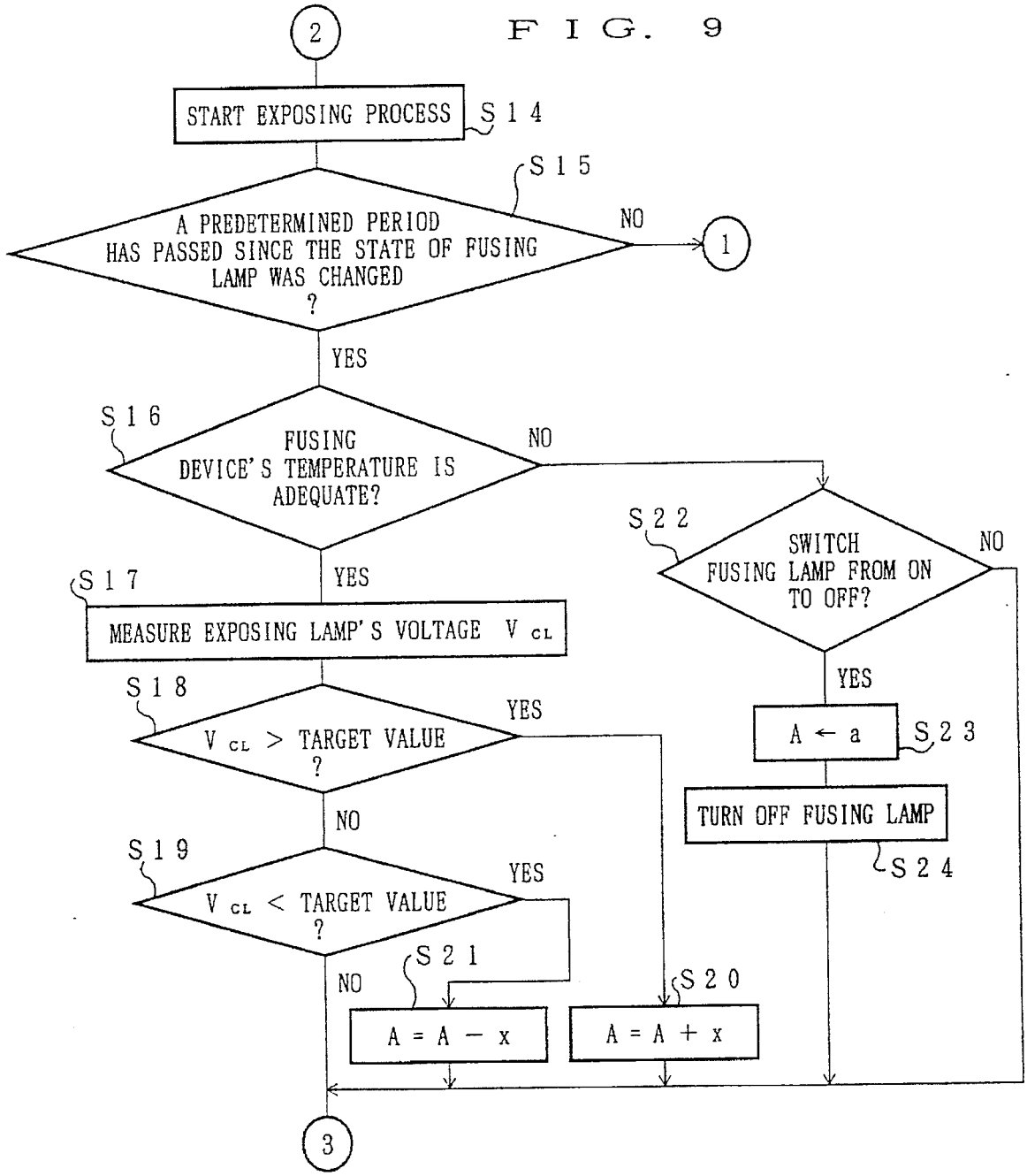
FIG. 9 is a flowchart detailing another example phase control of the exposing lamp.

On the other hand, when the predetermined time is judged to have passed in S13, the CPU 29 proceeds to S14 in FIG. 9 to start expose scanning by the exposing optical system 2.

Then, as shown in FIG. 9, the CPU 29 checks whether a predetermined time has passed since the fusing lamp 23 is switched to ON or OFF state after the exposing process started, namely, since the state of the fusing lamp 23 was changed (S15). When the predetermined time is not judged to have passed, the CPU 29 proceeds to S5. This is because it also takes a predetermined time to stabilize the light-up state of the fusing lamp 23.

On the other hand, when the predetermined time is judged to have passed in S15, the CPU 29 checks whether the temperature of the fusing device 18 is adequate or not, in other words, whether it is in a temperature range realizing satisfactory fusing (S16).

When the temperature of the fusing device 18 is judged as being adequate, the CPU 29 carries out a highly accurate feedback control detailed in S17 through S21. To be more specific, the CPU 29 takes in an actual voltage $V_{CL}$ applied to the exposing lamp 3 by means of the exposing lamp monitor voltage generating circuit 32 to measure the same (S17).

Next, the CPU 29 checks whether the voltage $V_{CL}$ is higher than a target voltage value pre-stored in the RAM 31 (S18). When the voltage $V_{CL}$ is not higher than the target voltage value, the CPU 29 checks whether the voltage $V_{CL}$ is lower than the target voltage value (S19). If the voltage $V_{CL}$ is not lower than the target voltage value either, meaning that the voltage $V_{CL}$ is the target voltage value, the CPU 29 proceeds to S26 in FIG. 10.

Figure 10:
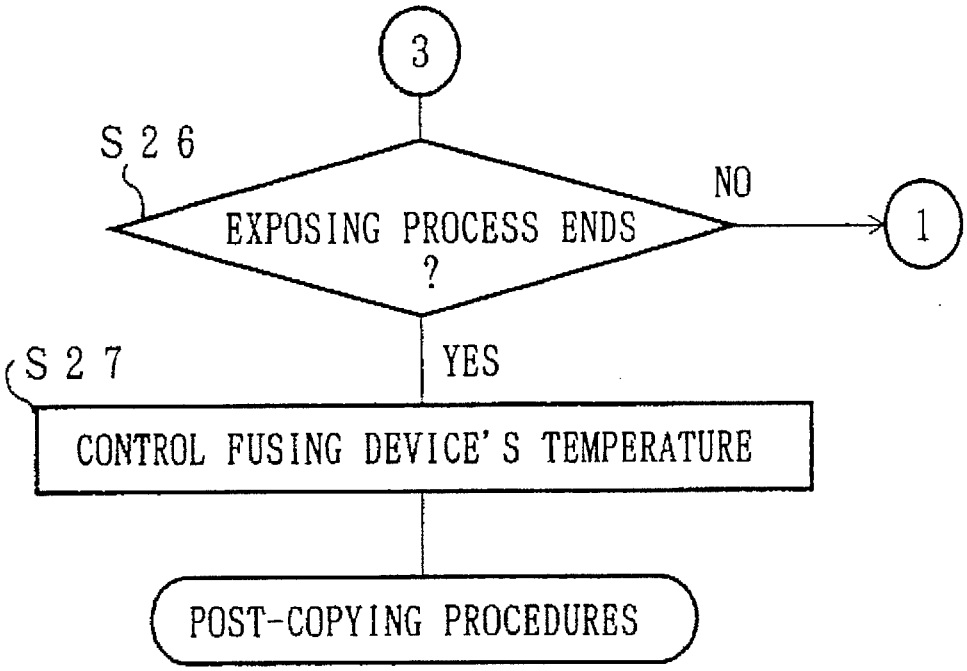
FIG. 10 is a flowchart detailing a further example phase control of the exposing lamp.

When the voltage $V_{CL}$ is higher than the target voltage value in S18, the CPU 29 adds a time x, which is sufficiently small with respect to A, to the value of the phase on time A (S20), and proceeds to S26 in FIG. 10. When the voltage $V_{CL}$ is lower than the target voltage value in S19, the CPU 29 subtracts the time x from the value of the phase on time A (S21). In short, when the exposing lamp monitor voltage (voltage $V_{CL}$) is high, the value of the phase on time A is increased to extend the time from the zero crossing signal to the light-up time, so that the voltage $V_{CL}$ actually applied to the exposing lamp 3 is reduced. Whereas when the exposing lamp monitor voltage (voltage $V_{CL}$) is low, the value of the phase on time A is reduced to cut the time from the zero crossing signal to the light-up time, so that the voltage $V_{CL}$ actually applied to the exposing lamp 3 is increased.

When the CPU 29 judges the temperature of the fusing device 18 as being inadequate in S16, the CPU 29 judges that the control on the temperature of the fusing device 18 is necessary, namely, the ON/OFF control of the fusing lamp 23. Then, the CPU 29 judges whether the control on the temperature of the fusing device 18 is the control to switch the fusing lamp 23 to OFF from ON state (S22). If the CPU 29 judges that the control on the temperature of the fusing device 18 is not the control to switch the fusing lamp 23 to OFF from ON state, the CPU 29 assumes the control on the temperature of the fusing device 18 is the control to switch the fusing lamp 23 to ON from OFF state, and proceeds to S26 in FIG. 10. In short, if the fusing lamp 23 were switched to ON from OFF state under these conditions, the voltage of the exposing lamp 3 would drop abruptly due to a rush current (increased by a factor of ten compared with a normal current) flowing into the fusing lamp 23. Accordingly, the light amount of the exposing lamp 3 would vary, thereby causing inconsistencies in copy density. To eliminate such inconsistencies in copy density, the switching of the fusing lamp 23 to ON from OFF state is inhibited while the exposing lamp 3 stays on or the exposing system 2 is in the exposing process.

On the other hand, when the CPU 29 judges that the control on the temperature of the fusing device 18 is the control to switch the fusing lamp 23 to OFF from ON state in S22, the CPU 29 skips the above-explained feedback control, and instead, controls the exposing lamp 3. To be more specific, the CPU 29 reads out phase on time data a pre-stored in the RAM 31 when switching the ON/OFF state of the fusing lamp 23 (when controlling the temperatures of the upper heat roller 21 and lower heat roller 22), and uses the readout data a as the phase on time A (S23). The phase on time data a are programmed in a memory of the RAM 31, for example, in the form of a table representing a relation of the phase time data a and the exposing lamp voltage when the fusing lamp 23 is switched to OFF from ON state.

Next, the CPU 29 turns off the fusing lamp 23 (S24), and proceeds to S26 in FIG. 10. As shown in FIG. 6, the voltage of the AC power source 27 increases by some volts at this point; however, since the phase on time A of the exposing lamp 3 has a constant value set in S23, the exposing lamp 3 is controlled in a satisfactory manner causing less voltage variance. Note that S24 is carried out in a predetermined period ranging from tens to some hundreds milliseconds during non-stabilized state of the AC power source voltage when the ON/OFF state of the fusing lamp 23 is switched (to OFF from ON state). Since the AC power source voltage is stabilized thereafter, the CPU 29 carries out a highly accurate feedback control by proceeding to S17 through S21.

Then, as shown in FIG. 10, the CPU 29 checks whether the exposing process ends or not (S26). When the CPU 29 judges that the exposing process has not ended yet, the CPU 29 proceeds to S5. Otherwise, the CPU 29 controls the temperature of the fusing device 18 (S27): the CPU 29 turns on the fusing lamp 23 again when the temperature of the fusing device 18 is below the predetermined temperature, or turns off the fusing lamp 23 when the temperature of the fusing device 18 is above the predetermined temperature. Then, the CPU 29 carries out post-copying procedures, such as staple processing of the transfer paper P on which a toner image has been fused.

In general, when the fusing lamp 23 is switched to 0N from OFF state, the voltage of the AC power source 27 drops abruptly due to the impedance of the transmission line of the AC power source 27 and gradually stabilizes as shown in FIG. 6. The voltage of the AC power source 27 at this point has decreased by an amount equal to an increase of current of the fusing lamp 23. If the CPU 29 carried out the highly accurate feedback control (S17 through S21) in a general manner at this moment of voltage drop (variance), the CPU 29 would excessively respond to the voltage variance of the AC power source 27 and change the voltage of the exposing lamp 23 considerably. Also, when the fusing lamp 23 is switched to OFF from ON state, the voltage of the AC power source 27 rises by some volts (the voltage of the AC power source 27 at this point is in an unstable period of tens to some hundreds milliseconds). If the CPU 29 carried out the highly accurate feedback control (S17 through S20) in a general manner during this unstable period where the voltage rises, like the above case where the fusing lamp 23 is switched to ON from OFF state, the CPU 29 would excessively respond to the voltage variance of the AC power source 27 and change the voltage of the exposing lamp 23 considerably. The adverse effect of the state switching of the fusing lamp 23 appears in the form of the inconsistencies (difference) in density of a resulting copy at a point where it was copied at the switching moment, thereby making it impossible to produce a desired copy.

Accordingly, the CPU 29 proceeds to S16 and S22 through S24 when the CPU 29 carries out the control as detailed by the flowcharts in FIGS. 8 through 10, that is, when the CPU 29 switches the fusing lamp 23 to OFF from ON state (when the CPU 29 controls the fusing lamp 23 to enable the fusing device 18 to maintain a predetermined temperature), thereby making it possible to produce a satisfactory copy having less inconsistencies in density.

In other words, the fusing lamp 23 is connected to the AC power source 27 in parallel with the exposing lamp 3, and the exposing lamp 3 is controlled to stay on for the phase on time A representing the phase control data pre-stored in the RAM 31 while the power source voltage varies in response to the switching of the power supply state to the fusing lamp 23 to OFF from ON. Accordingly, the exposing lamp 3 is not affected by the variance in voltage and can expose light in a constant amount, thereby making it possible to produce a satisfactory image having substantially no inconsistencies in density.

Figure 11:
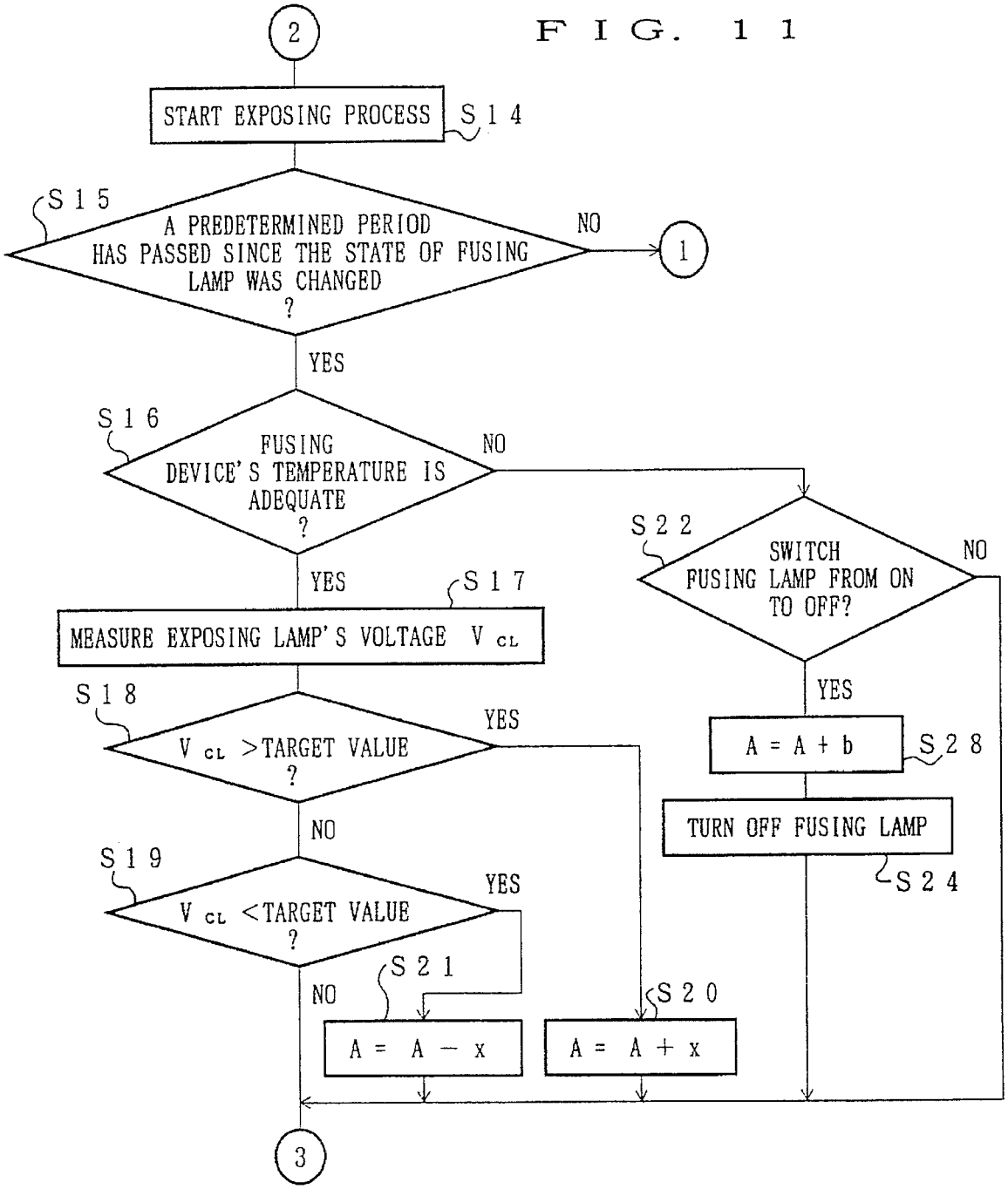
FIG. 11 is a flowchart detailing an example phase control of another exposing lamp in the above embodiment.

There is an alternative method of controlling the phase of the exposing lamp 3 while the ON/OFF state of the fusing lamp 23 is controlled. More precisely, as shown in FIG. 11, the pre-set phase on time A of the exposing lamp 3 is not replaced with the phase on time data a pre-stored in the RAM 31 in S23 of FIG. 9, but instead, phase on time correcting data b pre-stored in the RAM 31 may be added to the pre-set phase on time A of the exposing lamp 3.

According to the above control method, the phase on time correcting data b pre-stored in the RAM 31 are read out and added to the phase on time A, and the result is used as the latest phase on time A when the fusing lamp 23 is switched to OFF from ON state (when the temperatures of the upper heat roller 21 and lower heat roller 22 are controlled).

The phase on time correcting data b are set by taking into account that, when the fusing lamp 23 is switched to OFF from ON state, a current decreases by an amount flown to the fusing lamp 23 and, in turn, the voltage of the AC power source 27 rises (about three to five volts). Thus, the phase on time correcting data b are used to adjust the phase on time A of a light-up signal of the exposing lamp 3 corresponding to an amount of the increased voltage.

The phase on time correcting data b are programmed in a memory of the RAM 31 in the form of a table representing a relation between the phase time correcting data b and the voltage of the exposing lamp when the fusing lamp 23 is switched to OFF from ON state.

The latest phase on time A of the exposing lamp 3 is determined by taking into account an increase of some volts in the AC power source 27 when the fusing lamp 23 is switched to OFF from ON state. Therefore, when the fusing lamp 23 is switched to OFF from ON state, the phase on time remains at a constant value A. This makes the variance in voltage of the exposing lamp 3 small, and the irradiation amount of the exposing lamp 3 can be controlled in a satisfactory manner. As a result, a satisfactory image with less inconsistencies in copy density can be produced and the quality of the image can be upgraded.

Note that the phase time control of the exposing lamp 3 shown in FIG. 11 is carried out in the same manner as the control detailed in FIGS. 8 through 10 except for S23 of FIG. 9.

In the present embodiment, the phase control data including the phase on time data and phase on time correcting data are stored in the RAM 31; however, the phase control data may be pre-stored as a program in the ROM 30.

In the present embodiment, switching the fusing lamp 23 to ON from OFF state is inhibited while the exposing lamp 3 stays on, whereas the fusing lamp 23 is switched to OFF from ON by either re-writing the phase on time of the exposing lamp 3 or correcting the same using the pre-stored data in the RAM 31. In contrast, described in the second embodiment below is a control method of correcting the phase on time of the exposing lamp 3 when the ON/OFF state of the fusing lamp 23 is switched using the phase on time, which is corrected based on the voltage of the lit-up exposing lamp 3 while the temperature of the fusing device 18 is in a predetermined range first, and thence stored in the RAM 31.

[Second Embodiment]

Referring to FIGS. 8, 10, 12, and 13, the following description will describe another example embodiment of the present invention. Since the phase on time of the exposing lamp 3 is controlled in the same manner as the first embodiment, namely, the procedure detailed in S1–S13 of FIG. 8, and S26 and S27 of FIG. 10, and the description thereof is omitted herein. In the embodiments below, if the phase on time of the exposing lamp 3 is controlled in the same manner as shown in FIGS. 8 and 10, the description thereof is also omitted.

Figure 12:
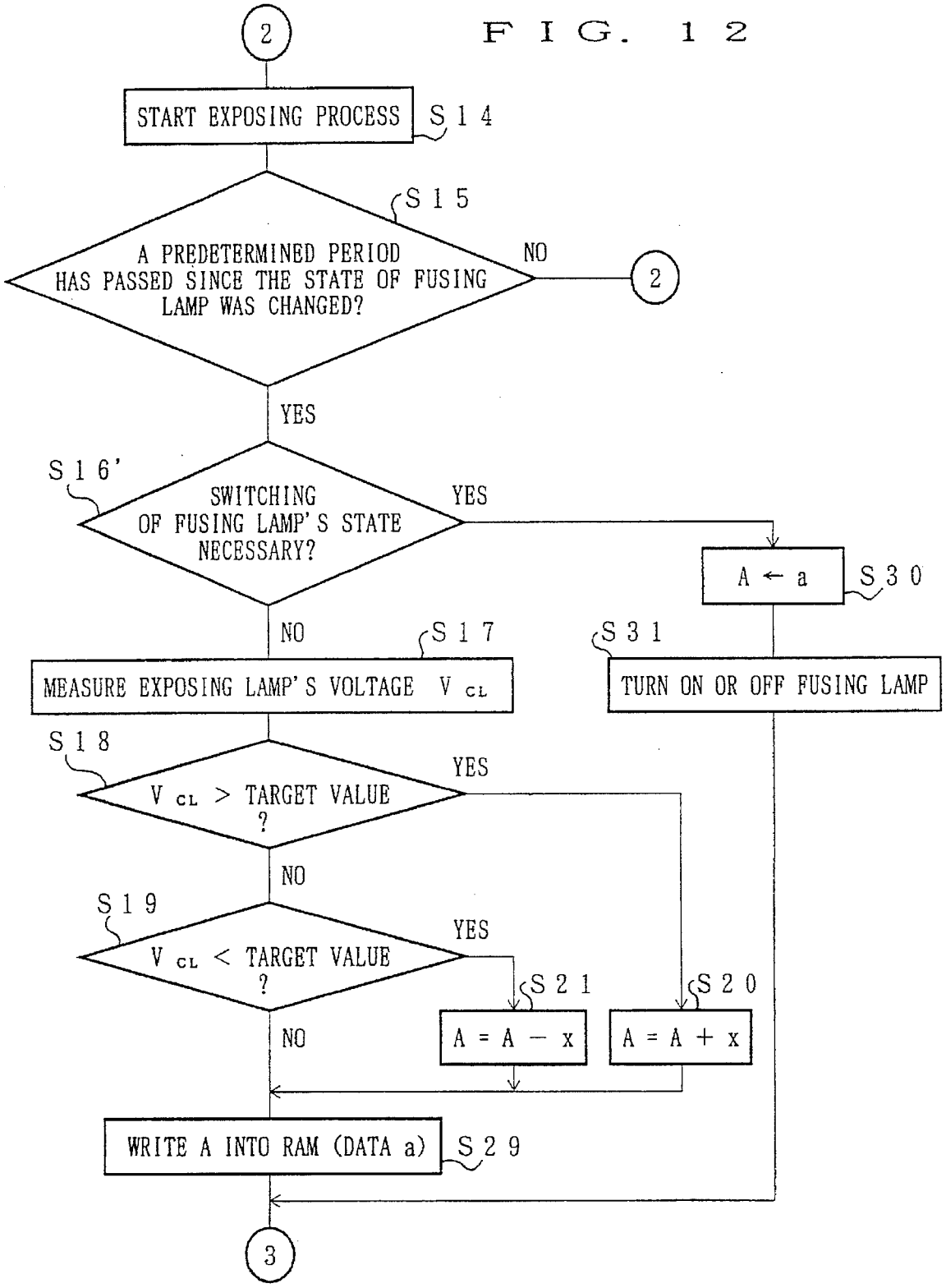
FIG. 12 is a flowchart detailing an example phase control of an exposing lamp in accordance with a further embodiment of the present invention.

The phase on time of the exposing lamp 3 is controlled in the following manner in the present embodiment. As shown in FIG. 12, after the exposing process starts (S14) and the fusing lamp 23 is switched to ON or OFF state, namely, after the state of the fusing lamp 23 is changed, the CPU 29 checks whether a predetermined time has passed or not (S15). When the CPU 29 judges that the predetermined time has not passed yet, the CPU 29 proceeds to S5 of FIG. 8. This is because it also takes some time to stabilize the light-up state of the fusing lamp 23.

When the CPU 29 judges that the predetermined time has not passed in S15, the CPU 29 checks whether it is necessary to change the state of the fusing lamp 23 of the fusing device 18 (S16').

When the CPU 29 judges that it is not necessary to change the state of the fusing lamp 23 of the fusing device 18, meaning that 'the temperature of the fusing device 18 is adequate, the CPU 29 takes in and measure a voltage $V_{CL}$ actually applied to the exposing lamp 3 by means of the exposing lamp monitor voltage generating circuit 32 (S17).

Next, the CPU 29 checks whether the voltage $V_{CL}$ is higher than a target value pre-stored in the RAM 31 (S18). When the voltage $V_{CL}$ is not higher than the target value, the CPU 29 checks whether the voltage $V_{CL}$ is lower than the target value (S19). When the voltage $V_{CL}$ is not lower than the target value either, meaning that the voltage $V_{CL}$ is the target value, the CPU 29 writes the phase on time A at this point into the RAM 31 as the phase control data (data a) (S29). Then, the CPU 29 proceeds to S26 of FIG. 10.

When the voltage $V_{CL}$ is higher than the target voltage value in S18, the CPU 29 adds a time x, which is sufficiently small with respect to A of the phase on time A, to the value of the phase on time A (S20), and writes the latest phase on time A into the RAM 31 in S29. Then, the CPU 29 proceeds to S26 of FIG. 10. When the voltage $V_{CL}$ is lower than the target voltage value in S18, the CPU 29 subtracts the time x from the value of the phase on time A (S21), and writes the latest phase on time A into the RAM 31 in S29. Then, the CPU 29 proceeds to S26 of FIG. 10. In other words, in case the exposing lamp monitor voltage (voltage $V_{CL}$) is high, a time from the zero cross signal to the light-up time is extended by increasing the value of the phase on time A to reduce the voltage $V_{CL}$ actually applied to the exposing lamp 3. Whereas in case the exposing lamp monitor voltage (voltage $V_{CL}$) is low, a time from the zero cross signal to the light-up time is reduced by decreasing the value of the phase on time A to increase the voltage $V_{CL}$ actually applied to the exposing lamp 3.

When the CPU 29 judges the state of the fusing lamp 23 of the fusing device 18 must be changed in S16' and the fusing lamp 23 is switched to OFF from ON or to ON from OFF state, the CPU 29 rewrites the phase on time A with the phase on time data a which was written into the RAM 31 in S29 (S30), and turns on or off the fusing lamp 23 (S31). Then, the CPU 29 proceeds to S26 of FIG. 10.

Since the preceding phase on time that has been actually used is used as has been explained, the phase of the exposing lamp 3 can be controlled in a precise manner.

The phase on time A written into the RAM 31 immediately before the control is used as the data a in S30 in the present embodiment; however, it may be arranged in the following manner. As shown in FIG. 13, the CPU 29 writes the phase on time A of a few cycles sequentially into the RAM 31 as data ak (k=1, 2, . . . , n). When the ON/OFF switching of the fusing lamp 23 turns out necessary in S16', the CPU 29 loads the data a1, a2, a3, . . . , an, stored in the RAM 31 into the self (S33), and carries out the phase control of the exposing lamp 3 using the average value of the data a1, a2, a3, . . . , an as the phase on time A (S34). Subsequently, the CPU 29 turns on or off the fusing lamp 23 (S35).

By using the average value of a few cycles as the actual phase on time before the switching action in the above-explained manner, variance in a voltage applied to the exposing lamp 3 can be small if the voltage from the AC power source 27 varies considerably.

The third embodiment below will describe another method of controlling the phase on time of the exposing lamp 3, in which a correction margin, namely, gain, of the phase on time of the exposing lamp 3 is made smaller than a predetermined value when switching the fusing lamp 23 to OFF from ON state while the exposing lamp 3 stays on.

[Third Embodiment]

Figure 14:
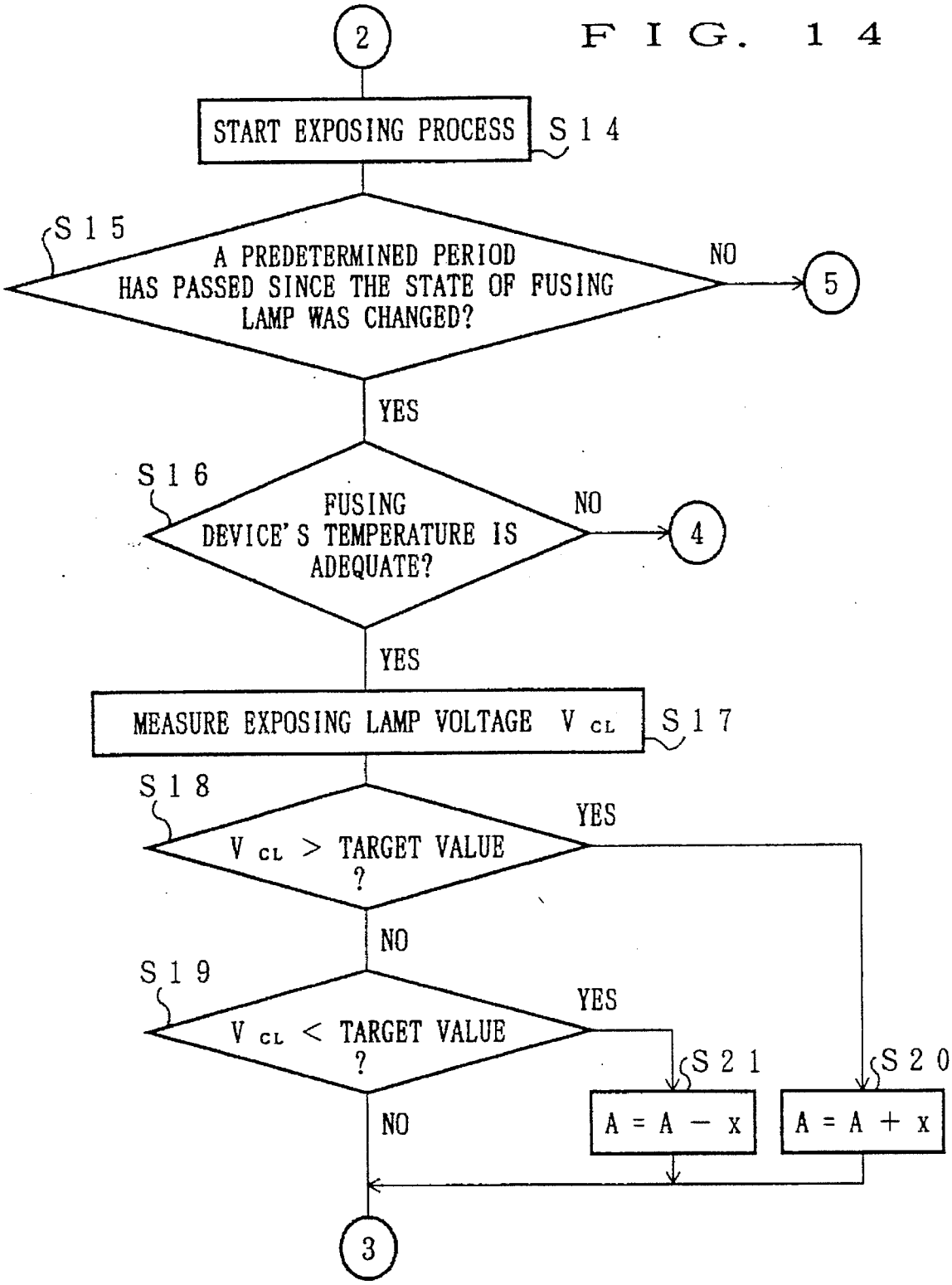
FIG. 14 is a flowchart detailing an example phase control of an exposing lamp in accordance with still another embodiment of the present invention.
Figure 15:
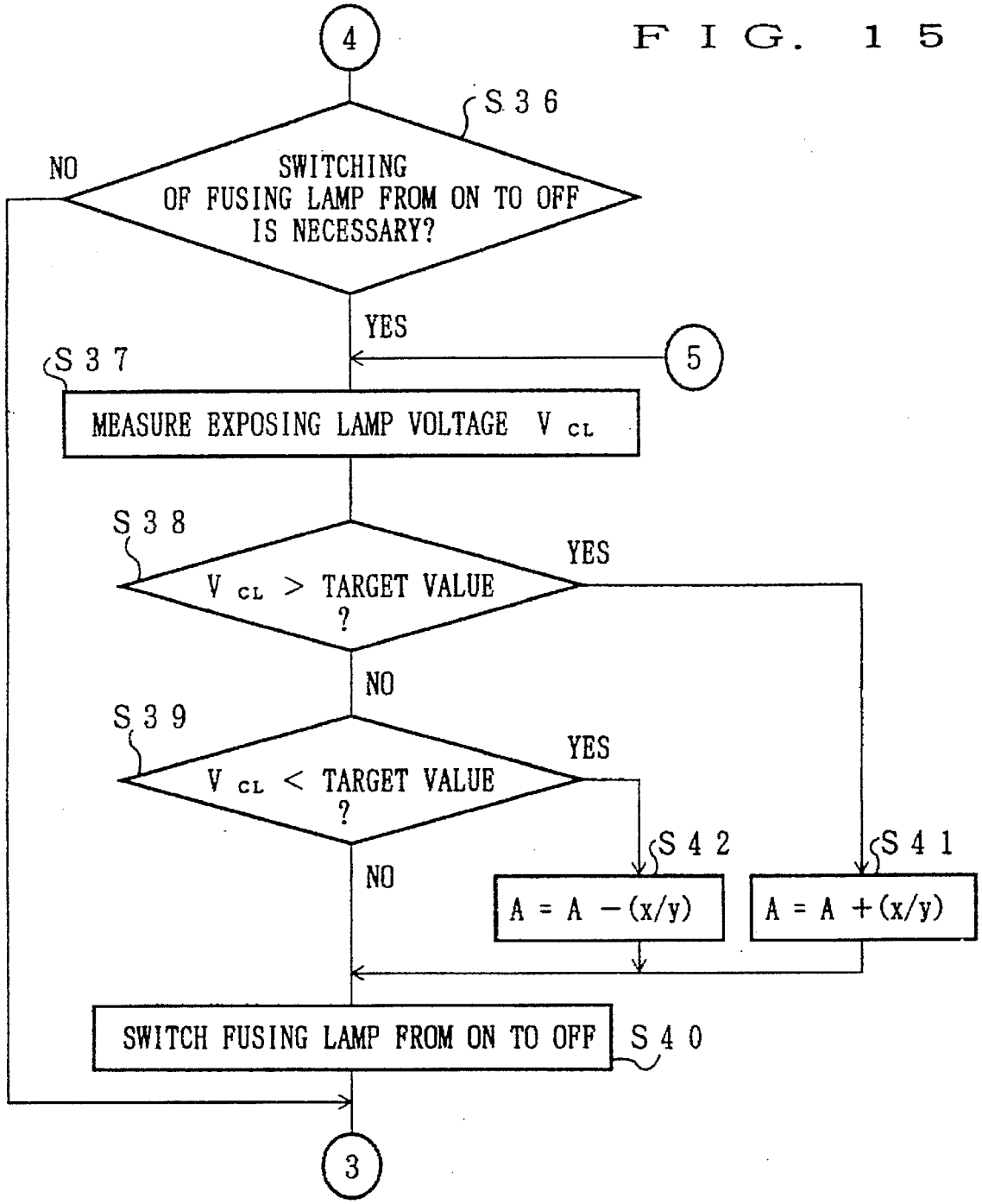
FIG. 15 is a flowchart detailing another example phase control of the exposing lamp in the above embodiment.

Referring to FIGS. 10, 14, and 15, the following description will describe a further example embodiment of the present invention.

The control of the phase on time of the exposing lamp 3 in accordance with the present embodiment is detailed in FIG. 14. More precisely, after the exposing process starts (S14), the CPU 29 checks whether a predetermined period has passed or not since the ON/OFF state of the fusing lamp 23 was switched, namely, since the state of the fusing lamp 23 was changed (S15). When the CPU 29 judges the predetermined time has not passed yet, the CPU 29 proceeds to S37 of FIG. 15.

When the CPU 29 judges that the predetermined time has passed in S15, the CPU 29 checks whether the temperature of the fusing device 18 is adequate or not (S16).

When the CPU 29 judges the temperature of the fusing device 18 is as being adequate, it takes in a voltage $V_{CL}$ actually applied to the exposing lamp 3 to measure the same by means of the exposing lamp monitor voltage generating circuit 32 (S17).

Next, the CPU 29 checks whether the voltage $V_{CL}$ is higher than a target voltage value pre-stored in the RAM 31 (S18). When the $V_{CL}$ is not higher than the target voltage value, the CPU 29 checks whether the $V_{CL}$ is lower than the target voltage value (S19). When the $V_{CL}$ is not lower than the target voltage value either, meaning that the $V_{CL}$ is the target voltage value, the CPU 29 proceeds to S26 of FIG. 10.

When the voltage $V_{CL}$ is higher than the target voltage value in S18, the CPU 29 adds a time x, which is sufficiently small with respect to A of the phase on time A, to the value of the phase on time A (S20) and writes the latest phase on time A into the RAM 31 in S29. Then, the CPU 29 proceeds to S26 of FIG. 10. When the voltage $V_{CL}$ is lower than the target voltage value in S19, the CPU 29 subtracts the time x from the value of the phase on time A (S21), and proceeds to S26 of FIG. 10. In other words, in case the exposing lamp monitor voltage (voltage $V_{CL}$) is high, a time from the zero cross signal to the light-up time is extended by increasing the value of the phase on time A to reduce the voltage $V_{CL}$ actually applied to the exposing lamp 3. Whereas in case the exposing lamp monitor voltage (voltage $V_{CL}$) is low, a time from the zero cross signal to the light-up time is reduced by decreasing the value of the phase on time A to increase the voltage $V_{CL}$ actually applied to the exposing lamp 3.

When the CPU 29 judges that the temperature of the fusing device 18 is not adequate in S16, the CPU 29 judges that the temperature of the fusing device 18, namely, the ON/OFF control of the fusing lamp 23, is necessary, and proceeds to S36 of FIG. 15.

The CPU 29 checks whether the temperature control of the fusing device 18 in S36 is a control to switch the fusing lamp 23 to OFF from ON state. When the CPU 29 judges the otherwise, the CPU 29 assumes that the temperature control of the fusing device 18 is a control to switch the fusing lamp 23 to ON from OFF state, and inhibits the switching control of the fusing lamp 23. Then, the CPU 29 proceeds to S26 of FIG. 10.

When the CPU 29 judges that the temperature control of the fusing device 18 in S36 is a control to switch the fusing lamp 23 to OFF from ON state, the CPU 29 measures the voltage $V_{CL}$ of the exposing lamp 3 by means of the exposing lamp monitor voltage generating circuit 32 (S37). Then, the CPU 29 judges whether the voltage $V_{CL}$ is higher than a target voltage value pre-stored in the RAM 31 (S38). When the voltage $V_{CL}$ is not higher than the target voltage value, the CPU 29 checks whether the voltage $V_{CL}$ is lower than the target voltage value (S39). When the CPU 29 judges that the voltage $V_{CL}$ is not lower than the target voltage value either, meaning that the voltage $V_{CL}$ is the target voltage value, the CPU 29 switches the fusing lamp 23 to OFF from ON state (S40), and proceeds to S26 of FIG. 10.

When the voltage $V_{CL}$ is higher than the target voltage value in S38, the CPU 29 adds a gain smaller than a normal phase correcting value (predetermined value) x (feedback amount) for one routine, namely, a phase correcting value $\frac{3}{7}$ which is $\frac{1}{7}$ of the normal phase correcting value x ($\frac{1}{4}$ or $\frac{1}{10}$ of the normal value), to the value of the phase on time A (S41). Then, the CPU 29 switches the fusing lamp 23 to OFF from ON state (S40), and proceeds to S26 of FIG. 10. The reference for computing the above phase correcting value is used as the feedback amount for one routine in the present embodiment; however, it may be a phase feedback amount computed using a difference between the monitor voltage and the target voltage of the exposing lamp 3.

When the voltage $V_{CL}$ is lower than the target voltage value in S39, the CPU 29 subtracts a gain smaller than a normal phase correcting value (predetermined value) x (feedback amount) for one routine, namely, a phase correcting value $x/y$ which is $1/y$ of the normal phase correcting value x (1/4 or 1/10 of the normal value), from the value of the phase on time A (S42). Then, the CPU 29 switches the fusing lamp 23 to OFF from ON state (S40), and proceeds to S26 of FIG. 10. In other words, in case the exposing lamp monitor voltage (voltage $V_{CL}$) is high, a time from the zero cross signal to the light-up time is extended by increasing the value of the phase on time A to reduce a voltage actually applied to the exposing lamp 3. Whereas in case the exposing lamp monitor voltage (voltage $V_{CL}$) is low, a time from the zero cross signal to the light-up time is reduced by decreasing the value of the phase on time A to increase a voltage actually applied to the exposing lamp 3.

By making the gain in the feedback control small when the fusing lamp 23 is switched to OFF from ON state as has been explained, in other words, by reducing the amount of variance in phase in response to the variance of the voltage $V_{cl}$ of the exposing lamp 3 detected by the exposing lamp monitor voltage generating circuit 32, an excessive response to the voltage variance of the exposing lamp 3 can be prevented, thereby making it possible to supply a voltage to the exposing lamp 3 in a stable manner.

Thus, a constant voltage can be applied to the exposing lamp 3, and therefore, a satisfactory image can be produced without causing any inconsistency in copy density at a point where a copy was made at the moment of switching the ON/OFF state of the fusing lamp 23.

The CPU 29 carries out the above control in a predetermined period, namely, tens to some hundreds milliseconds while the voltage of the AC power source 27 is not stabilized when the ON/OFF state of the fusing lamp 23 is switched (to OFF from ON). Subsequently, the CPU 29 carries out the highly accurate feedback control detailed in S17 through 20. If the temperature of the fusing device 18 is low when the exposing process ends, the CPU 29 controls the temperature of the fusing device 18 by, for example, turning on the fusing lamp 23.

The phase of the exposing lamp 3 is controlled after the copying process is started in the first through third embodiments. On the contrary, the phase of the exposing lamp 3 is carried out immediately after the copying machine is turned on or during the warm-up in the fourth embodiment below.

[Fourth Embodiment]

Figure 16:
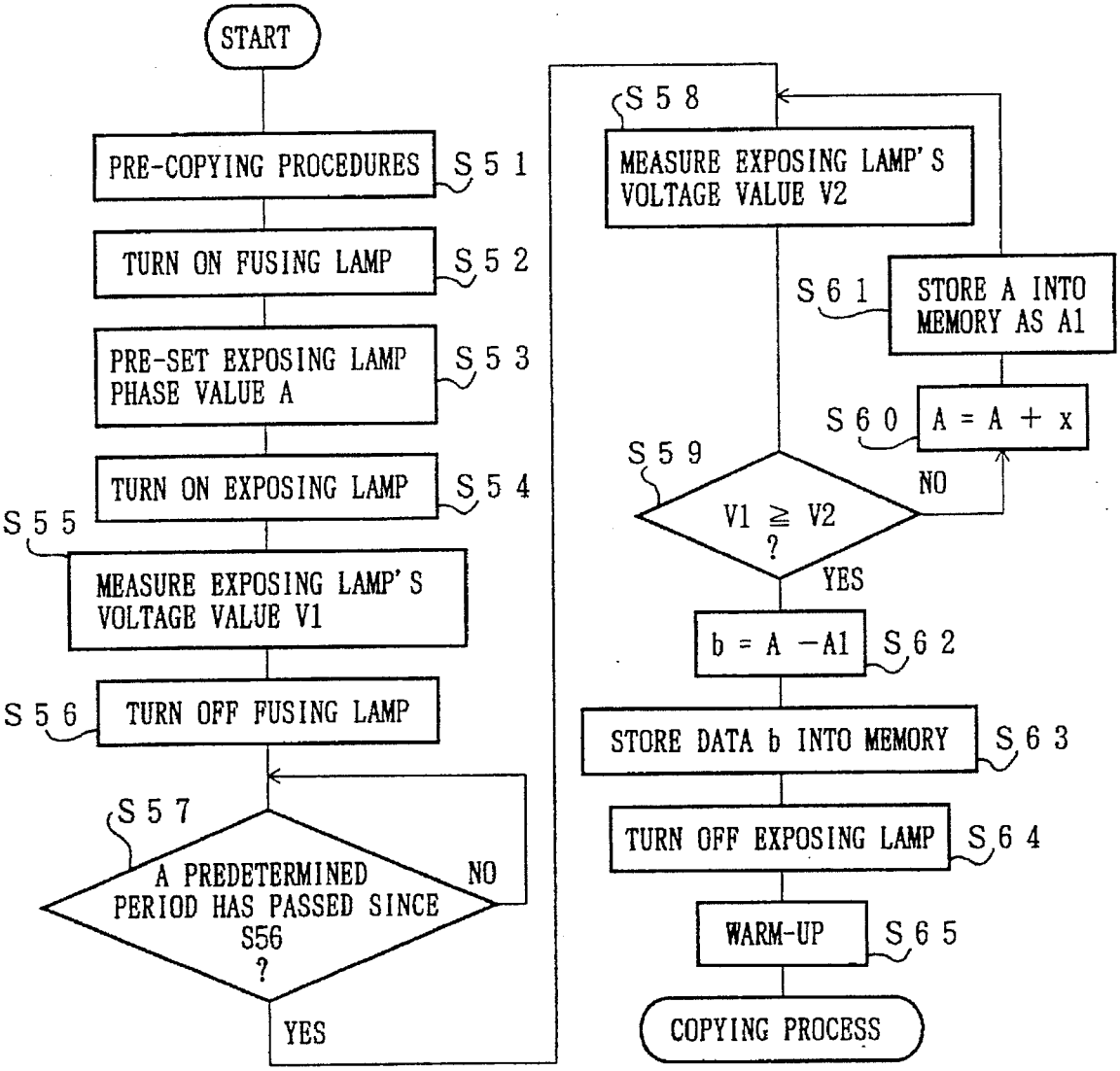
FIG. 16 is a flowchart detailing an example phase control of an exposing lamp in accordance with still another embodiment of the present invention.

Referring to FIG. 16, the following description will describe still another example embodiment of the present invention.

As shown in FIG. 16, the control on the phase on time of the exposing lamp 3 of the present embodiment starts when the copying machine is turned on and the CPU 29 is activated to carry out pre-copying procedures such as paper jam check or display processing (S51). Subsequently, the CPU 29 turns on the fusing lamp 23 (S52), and pre-sets the phase data a1 to the phase on time A to determined a phase value of the exposing lamp 3 (S53).

Then, the CPU 29 keeps the exposing lamp 3 turned on for a period from the zero cross signal to the phase data a1 (S54), and measures the exposing lamp voltage, referred to as a value V1 hereinafter, by means of the exposing lamp monitor voltage generating circuit 32 when the exposing lamp monitor voltage is stabilized (S55). Then, the CPU 29 turns off the fusing lamp 23 while keeping the exposing lamp 3 turned on (S56), and judges that the voltage of the AC power source 27 is stabilized when a predetermined period has passed since the fusing lamp 23 was turned off (S57). Then, the CPU 29 again measures an exposing lamp voltage value, which is referred to as a value V2 hereinafter (S58). Note that, however, the voltage of the AC power source 27 rises by some volts for a short period after the fusing lamp 23 is turned off, and no voltage is measured during this period.

At this point, V2 is always higher than V1. In other words, although the voltage of the AC power source 27 is high, the phase on time to keep the exposing lamp 3 turned on remains intact, and therefore, the voltage V2 becomes higher than V1 in the exposing lamp 3. Thus, to make V1=V2, the CPU 29 checks whether V1≧V2 (S59). When V1<V2, the CPU 29 adds a correcting value x to the phase on time A of the exposing lamp 3 to reduce the voltage of the exposing lamp 3 (S60). Then, the CPU 29 stores the corrected phase on time A into a memory of the RAM 31 as A1 (S61), and proceeds to S58 again to measure the voltage value V2 of the exposing lamp 3 (herein, the exposing lamp 3 is turned as follows: a phase on signal is turned off immediately after the exposing lamp 3 is turned on upon receipt of the phase on signal).

When Vl=V2 in S59, the CPU 29 computes a balance between the data A and data A1, which is referred to as data b (S62), and stores the same into the memory of the RAM 31 (S63). The data b can also be used as the exposing lamp phase correcting value of the first embodiment. Then, the CPU 29 turns off the exposing lamp 3 (S64), and enters a ready state following the normal warm-up (S65). Subsequently, a copying process is carried out in a normal manner.

After the ready state, a phase value of the exposing lamp 3 is determined based on the flowchart shown in FIG. 11 of the first embodiment.

As has been explained, since the process for determining the phase of the exposing lamp is carried out immediately after the copying machine main body is turned on or during the warm-up in the present embodiment, the CUP 29 does not have to carry out the phase control while a copy is being made. Thus, the CPU 29, the busiest instrument during the copying process, can reduce the jobs, thereby making it possible to employ a low-speed CPU. As a result, a less expensive electrophotographic device, such as a copying machine, using an inexpensive low-speed CPU becomes available.

As previously mentioned, in the phase control of the exposing lamp 3 in the first through fourth embodiments, switching the fusing lamp 23 to OFF from ON state and vice versa is inhibited or controlled while the exposing lamp 3 stays on. If the ON or OFF state of the fusing lamp 23 is maintained while the exposing lamp 3 stays on and the temperature of the fusing device 18 becomes out of a temperature range realizing satisfactory fusing, the temperature of the fusing device 18 is restored after the exposing process.

The fifth through seventh embodiments will describe a copying machine, in which the temperature of the fusing lamp 23 is also controlled to keep the temperature of the fusing device 18 in a temperature range realizing satisfactory fusing while the exposing lamp 3 stays on.

[Fifth Embodiment]

Figure 17:
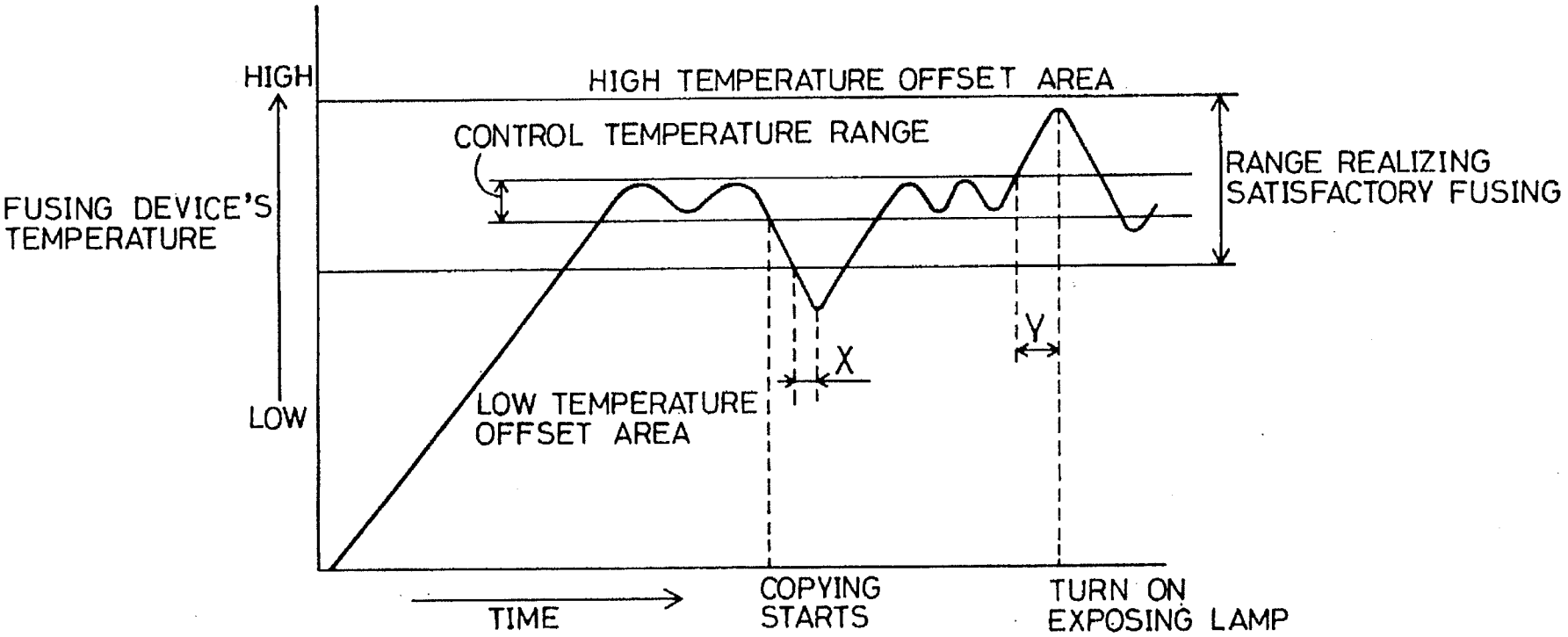
FIG. 17 is a graph showing an example temperature control of a fusing device in accordance with still another example embodiment of the present invention.
Figure 18:
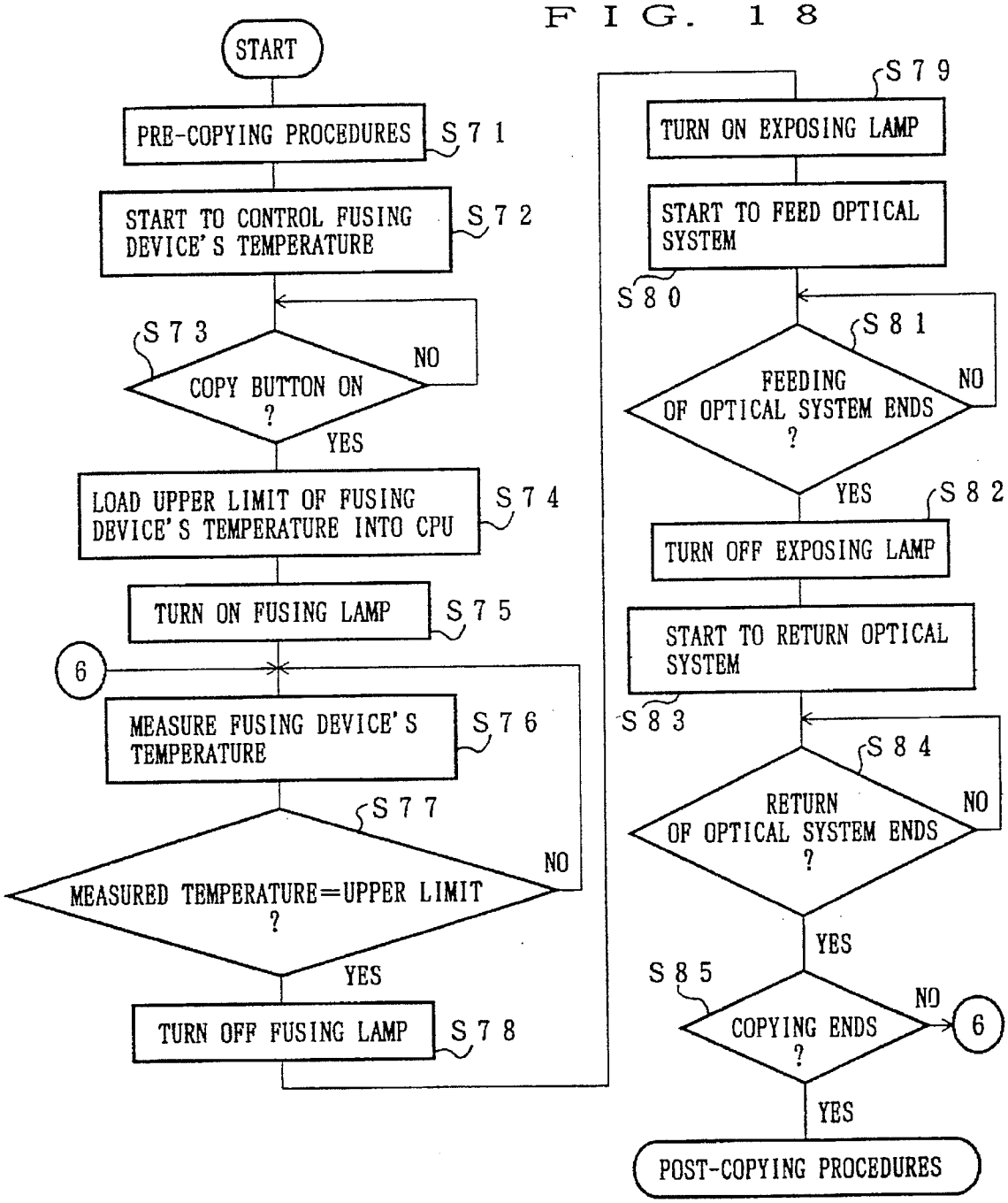
FIG. 18 is a flowchart detailing a temperature control of the fusing device in the above embodiment.

Referring to FIGS. 5, 17, and 18, the following description will describe still another example embodiment of the present invention.

As has been explained in the first embodiment, the fusing device 18 in accordance with the present embodiment includes the upper heat roller 21 made of a thin cylindrical aluminum tube of about 1 mm thick having a relatively small heat capacity. Thus, the temperature of the fusing device 18 varies in a considerable range if the fusing lamp 23 is kept turned on or off to control the phase of the exposing lamp 3. More precisely, if the fusing lamp 23 remains in the ON state, the temperature of the upper heat roller 21 becomes too high, while if the fusing lamp 23 remains in the OFF state, the temperature of the upper heat roller 22 becomes too low. If the temperature of the fusing device 18 becomes too high or low, it may become out of the temperature range realizing satisfactory fusing. Therefore, if the fusing process is carried out under these conditions, there readily occurs defective fusing. The defective fusing caused when the temperature is too high is referred to as the high temperature offset, while the defective fusing caused when the temperature is too low is referred to as the low temperature offset.

In case of a copying machine, a temperature control range (control temperature range) for the fusing device 18 is determined within a temperature range realizing satisfactory fusing. For example, when the upper and lower limits of the temperature range realizing satisfactory fusing are 160° C. and 140° C., respectively, the temperature of the fusing device 18 is controlled in the control temperature range between 148° C. and 152° C. When the temperature range realizing satisfactory fusing is between 140° C. and 160° C. and the fusing lamp 23 has an output of about 600 W, the surface temperature of the upper heat roller 21 rises from 20° C. to 150° C. in about twenty seconds.

As has been explained in each embodiment above, the voltage of the AC power source 27 drops abruptly in tens to some hundreds milliseconds due to a rush current when the fusing lamp 23 (halogen lamp) inside of the fusing roller 18 is switched to ON from OFF state. Such an abrupt voltage drop makes the phase control of the exposing lamp 3 unreliable. This is the reason why the switching of the fusing lamp 23 to ON from OFF state is prohibited while the exposing lamp 3 stays on (optically scans) in the above embodiments.

As previously mentioned, the fusing device 18 of the copying machine includes the thin upper heat roller 21 (about 1 mm thick) having a small heat capacity. Thus, when a transfer paper P is passed through the fusing device 18 to fuse a toner image onto the transfer paper P while the fusing lamp 23 is turned off, the temperature of the upper heat roller 21 drops in a relatively short time below the temperature range realizing satisfactory fusing (denoted by a capital letter X in FIG. 17). This is because the heat of the upper heat roller 21 is removed by the transfer paper P. For example, the temperature of the upper heat roller 21 drops by 16° C. when the transfer paper P is an A-4 size. If the fusing process is carried out under these conditions, there occurs the low temperature offset, in particular, at the bottom end of the transfer paper P. In the above case, for example, assume that the temperature of the upper heat roller 21 before the transfer paper P passes through a section between the upper heat roller 21 and lower heat roller 22 is 152° C., the temperature of the upper heat roller 21 drops to 136° C. Since 136° C. is below the lower limit of the temperature range realizing satisfactory fusing, there occurs the low temperature offset and hence defective fusing.

Although such temperature drop caused by the transfer paper P can be curbed by using a thicker upper heat roller 21 having a larger heat capacity, the warm-up takes longer in turn.

Thus, the control of the fusing temperature of the above fusing device 18 including the thick upper heat roller 21 will be explained in the present embodiment with reference to the flowchart of FIG. 18.

To begin with, the CPU 29 is activated when the copying machine is turned on, and the CPU 29 carries out pre-copying procedures, such as paper jam check or display processing (S71). Then, the CPU 29 turns on the fusing lamp 23 and controls the temperature thereof for warming up the fusing device 18 (S72), and enters the ready state.

Next, when a copy button is pressed (S73), the CPU 29 enters a copy sequence, and the CPU 29 loads the upper limit of the fusing control temperature pre-programmed in the ROM 30 into the self (S74). Note that, the upper limit referred herein is not the upper limit of the control temperature range, but the upper limit of the temperature range realizing satisfactory fusing. Subsequently, the CPU 29 turns on the fusing lamp 23 (S75). Here, since the upper limit of the fusing control temperature is higher than that of the normal control temperature range, there occurs no problem in fusing if the fusing lamp 23 is forcibly turned on.

Next, the CPU 29 measures the temperature of the fusing device 18 (S76), and further checks whether it has reached the upper limit of the fusing control temperature (S77). When the CPU 29 judges that the temperature of the fusing roller 18 has reached the upper limit of the fusing control temperature, the CPU 29 turns off the fusing lamp 23 (S78), turns on the exposing lamp 3 (S79), feeds the exposing optical system (hereinafter, referred to as the optical system) 2 (S80), and starts the copying operation. When the feeding of the optical system 2 ends (S81), the CPU 29 turns off the exposing lamp 3 (S82) and starts to return the optical system 2 to its original position (S83). When the optical system 2 has returned to its original position (S84), the CPU 29 checks whether the copying operation ends or not (S85). When the copying operation has not ended yet, in other words, the second copy and thereafter are being made in the multi-copy mode, the CPU 29 proceeds to S76 to return to the start of the same flow, and raises the temperature of the fusing device 18 up to the upper limit of the temperature range realizing satisfactory fusing. Then, the CPU 29 turns off the fusing lamp 23 to start the copying operation again. When the copying operation has ended in S85 and the temperature of the fusing device 18 has not been restored yet, the CPU 29 restores the temperature of the fusing device 18 in the post-processing period. Note that the copying machine is programmed in such a manner that a post-fused transfer paper P has been released from the copying machine by the time the optical system returns to its original position.

As has been explained, the temperature of the fusing device 18 is controlled to remain in the control temperature range shown in FIG. 17 while a copy is being made in the present embodiment. When the copy cycle is started, the CPU 29 turns on the fusing lamp 23 to increase the temperature of the upper heat roller 21 around the upper limit of the temperature range realizing satisfactory fusing above the upper limit of the control temperature range (denoted by a capital letter Y in the drawing). Before the CPU 29 turns on the exposing lamp 3, namely, before the exposing process, the CPU 29 turns off the fusing lamp 23, turns on the exposing lamp 3, and feeds the optical system 2. For example, in case that the copy button is turned on when the CPU 29 controls the temperature of the upper heat roller 21 in a range between 148° C. and 152° C., the CPU 29 increases the temperature of the upper heat roller 21 to 160° C., which is the upper limit of the temperature range realizing satisfactory fusing, and turns off the fusing lamp 23. The temperature of the upper heat roller 21 drops by 16° C. after the toner image is fused onto the transfer paper P of A-4 size. Thus, the temperature of the post-fusing upper heat roller 21 drops to 144° C., which is in the temperature range realizing satisfactory fusing since its lower limit is 140° C. as previously mentioned. Note that, however, the upper limit of the temperature range realizing satisfactory fusing varies depending on the materials, namely performance, of the toner and upper heat roller 21.

As has been explained, since the fusing lamp 23 is kept turned off while the exposing lamp 3 stays on (optically scans), the temperature of the upper heat roller 21 drops. However, the temperature of the upper heat roller 21 remains in the temperature range realizing satisfactory fusing shown in FIG. 17 after as the transfer paper P has passed through the fusing device 18 and a copy is made. Thus, a satisfactory copying can be produced without causing the low temperature offset or the like under these conditions. That is to say, the CPU 29 does not have to raise the temperature of the fusing lamp 23 after the exposing process in most of the cases, thereby making it possible to accelerate the copying operation.

Since the temperature of the fusing lamp 23 remains in the temperature range realizing satisfactory fusing when the temperature of the fusing lamp 23 is not controlled while the exposing lamp 3 stays on, the exposing lamp 3 is hardly affected by the variance in voltage.

Accordingly, it becomes possible to curb the inconsistencies in copy density caused when the voltage of the power source varies by switching the power supply to OFF from ON state while a copy is being made. Moreover, an image can be fused in a satisfactory manner, and a resulting image is satisfactory as well.

The CPU 29 may turn on the exposing lamp 3 in S79 without turning off the fusing lamp 23 in S78. Subsequently, like the first through fourth embodiments, the exposing lamp 3 can be controlled using the phase on time data a or phase on time correcting data b stored in the RAM 31 when the power supply to the fusing lamp 23 is switched to OFF from ON state while the exposing lamp 3 stays on.

In the fifth embodiment, the temperature of the fusing device 18 is controlled in the predetermined control temperature range; however, the control temperature range can be expanded by bringing the upper limit thereof to around the upper limit of the temperature range realizing satisfactory fusing. The sixth embodiment below will describe a case where the temperature control range of the fusing device 18 is expanded.

[Sixth Embodiment]

Figure 19:
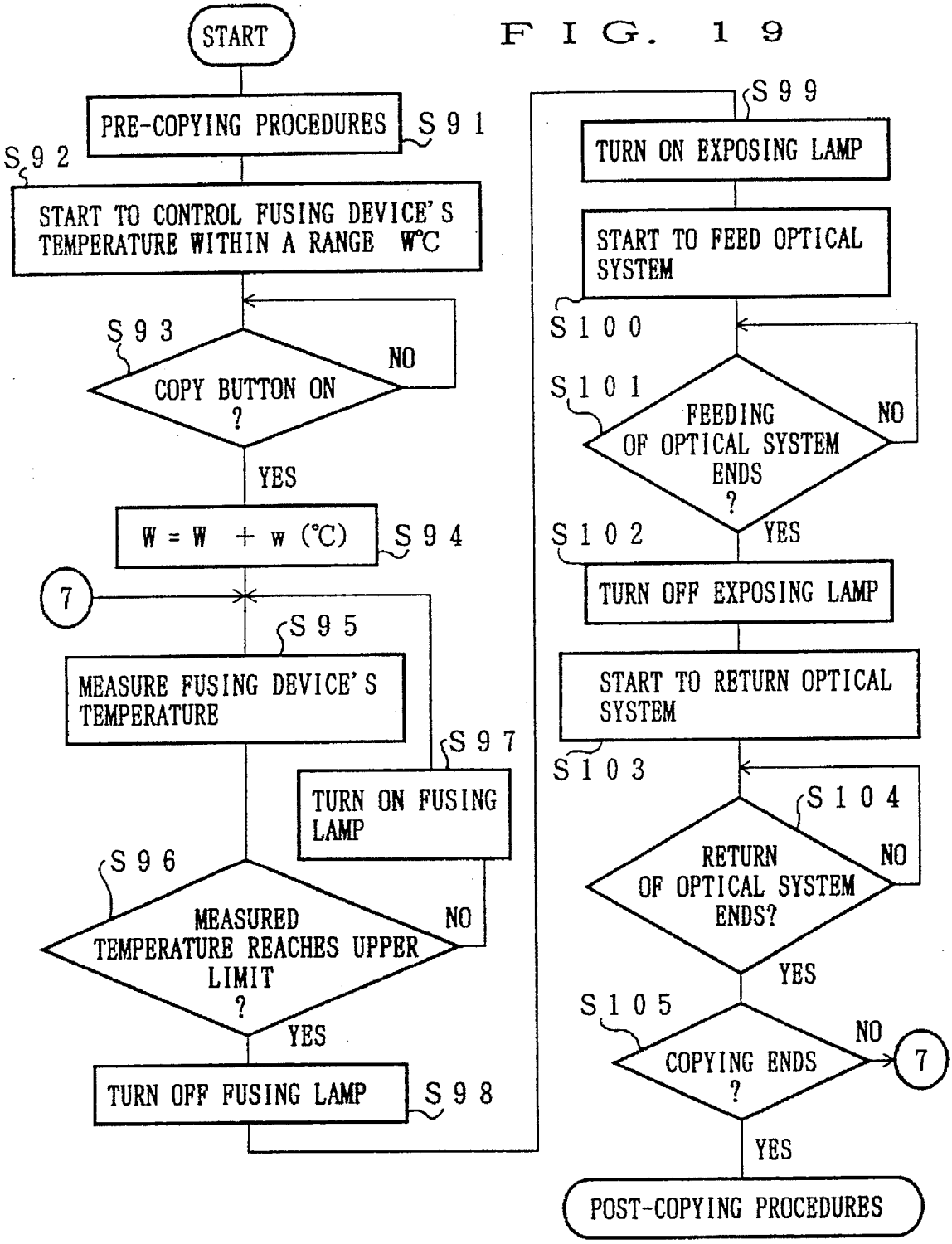
FIG. 19 is a flowchart detailing a temperature control of a fusing device in accordance with still another example embodiment of the present invention.
Figure 20:
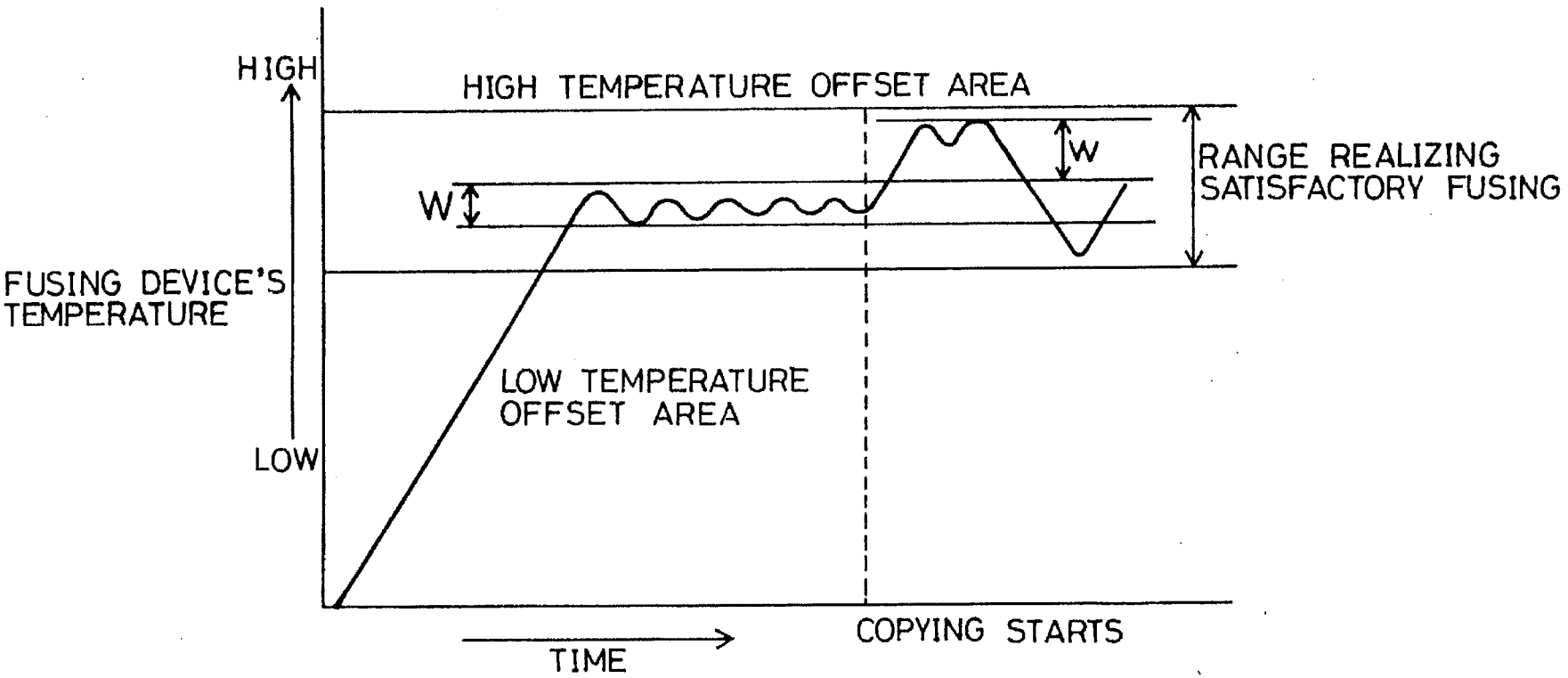
FIG. 20 is a graph showing a result of the temperature control of the fusing device detailed by the flowchart of FIG. 19.

Referring to FIGS. 5, 19, and 20, the following description will describe still another example embodiment of the present invention.

The control on the temperature of the fusing lamp 23 in the electrophotographic apparatus in accordance with the present embodiment will be explained with reference to the flowchart in FIG. 19.

To begin with, the CPU 29 is activated when the power is turned on, and carries out pre-copying procedures, such as paper jam check and display processing (S91). Then, the CPU 29 turns on the fusing lamp 23 to warm up the fusing device 18 and starts the temperature control within the control temperature range W° C. (S92), and enters ready state. As shown in FIG. 20, the temperature of the fusing device 18 at this point is kept within the control temperature range W° C. until the copying operation starts.

Next, when the copy button is pressed (S93), the CPU 29 enters the copy sequence. The CPU 29 adds the correcting value w, which is within the control temperature range pre-programmed in the ROM 30, to the above control temperature range W, and uses the resulting W+w° C. as the control temperature range of the fusing device 18 (S94). Note that the correcting value w is set to a value such that keeps the W+w below the upper limit of the temperature range realizing satisfactory fusing during the ready state. For example, assume that the upper limit of a normal control range is 180° C and the upper limit that does not cause the high temperature off set is 200° C., then 180(W)+19(w)= 199(°°C.). Thus, 199° C. is used as the upper limit of the control temperature range when the temperature of the fusing device 18 is controlled.

Next, the CPU 29 measures the temperature of the fusing device 18 (S95), and checks whether the measured temperature has reached the upper limit or not (S96). When the measured temperature has not reached the upper limit, the CPU 29 forcibly sends a light-up signal to the fusing lamp 23 to turn on the same (S97). Otherwise, the CPU 29 turns off the fusing lamp 23 (S98), turns on the exposing lamp 3 (S99), and feeds the exposing optical system (hereinafter, referred to as the optical system) 2 (S100) to start the copying operation. When the feeding of the optical system 2 ends (S101), the CPU 29 turns off the exposing lamp 3 (S102), and starts to return the optical system 2 to its original position (S103). When the optical system 2 has returned to its original position (S104), the CPU 29 checks whether the copying operation has ended or not (S105). When the copying operation has not ended yet, in other words, the second copy and thereafter are being made in the multi-copy mode, the CPU 29 proceeds to S95 to return to the start of the same flow, and raises the temperature of the fusing device 18 up to the upper limit of the temperature range realizing satisfactory fusing. Subsequently, the CPU 29 turns off the fusing lamp 23 and starts the copying operation again. When the copying operation has ended in S105 and the temperature of the fusing device 18 has not been restored yet, the CPU 29 restores the temperature of the fusing device 18 in the post-processing period. Note that the copying machine is programmed in such a manner that the transfer paper P onto which the toner image was fused has been released from the copying machine by the time the optical system 2 returns to its original position.

As shown in FIG. 20, the temperature of the fusing device 18 is controlled within the control temperature range W during the ready state, and after the copying operation starts, within a range expanded to around the upper limit of the temperature range realizing satisfactory fusing, namely, the temperature control range W+w.

The temperature of the fusing lamp 23 can be raised to the upper limit of the control temperature range by expanding the temperature control range of the fusing device 18 to raise the upper limit higher after the copying operation starts. The fusing lamp 23 is turned off when the exposing lamp 3 starts the exposing process, that is to say, when the exposing lamp 3 is turned on (starts the optical scanning). The temperature of the upper heat controller 21 drops when the fusing lamp 23 is turned off. However, since the temperature of the fusing lamp 23 is raised to around the upper limit of the control temperature range before the temperature drops, the temperature of the upper heat roller 21 does not drop below the lower limit of the temperature range realizing satisfactory fusing even after the transfer paper P has passed through the fusing device 18 and the copying operation has ended. In other words, since the temperature of the upper heat roller 21 remains in the temperature range realizing satisfactory fusing shown in FIG. 20, a satisfactory copy can be produced without causing the low temperature offset.

Since the temperature of the fusing lamp 23 remains in the temperature range realizing satisfactory fusing even if the temperature of the fusing lamp 23 is not controlled while the exposing lamp 3 stays on, the exposing lamp 3 is hardly affected by the variance in voltage.

Accordingly, it becomes possible to curb the inconsistencies in copy density caused when the voltage of the power source varies by switching the power supply to the fusing lamp 23 to OFF from ON state while a copy is being made. Moreover, an image can be fused in a satisfactory manner, and a resulting image is satisfactory as well.

In the present embodiment, the low temperature offset caused when the temperature of the upper heat roller 21 drops can be prevented by increasing the upper limit of the control temperature range to around the upper limit of the temperature range realizing satisfactory fusing by adding the correcting value w within the control temperature range programmed in the ROM 30 since the copying operation started. However, the same can be done by raising the temperature of the fusing device 18 by turning on the fusing lamp 23 forcibly for a predetermined period after the copying operation starts, which will be explained in the seventh embodiment below.

[Seventh Embodiment]

Figure 21:
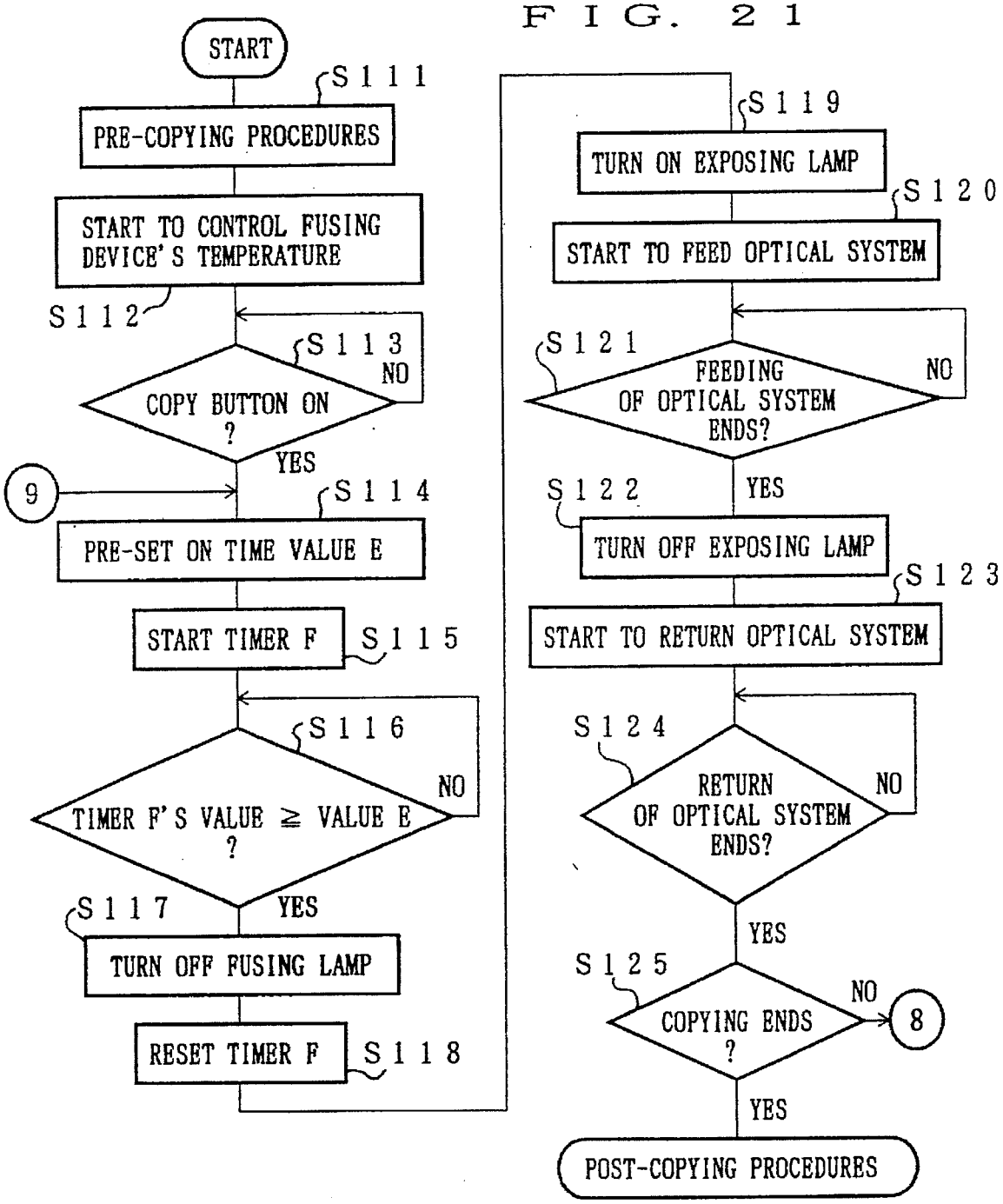
FIG. 21 is a flowchart detailing a temperature control of a fusing device in accordance with still another example embodiment of the present invention.
Figure 22:
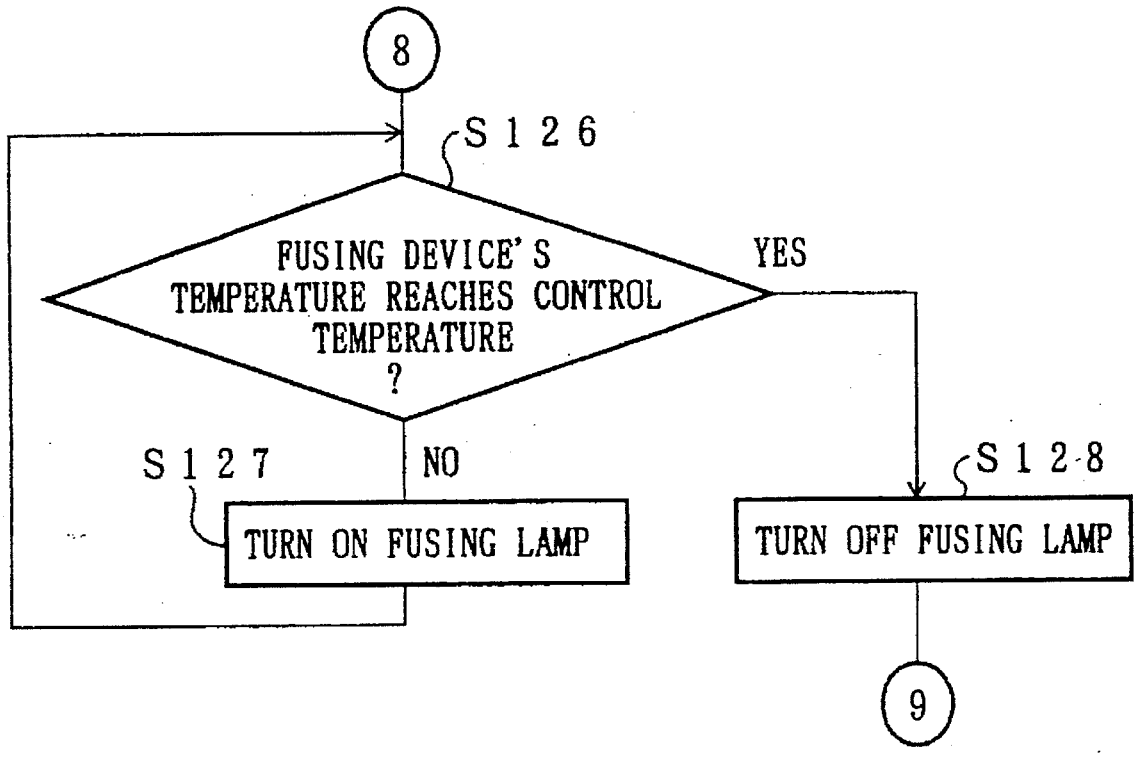
FIG. 22 is a flowchart detailing the above temperature control of the fusing device in the above embodiment.
Figure 23:
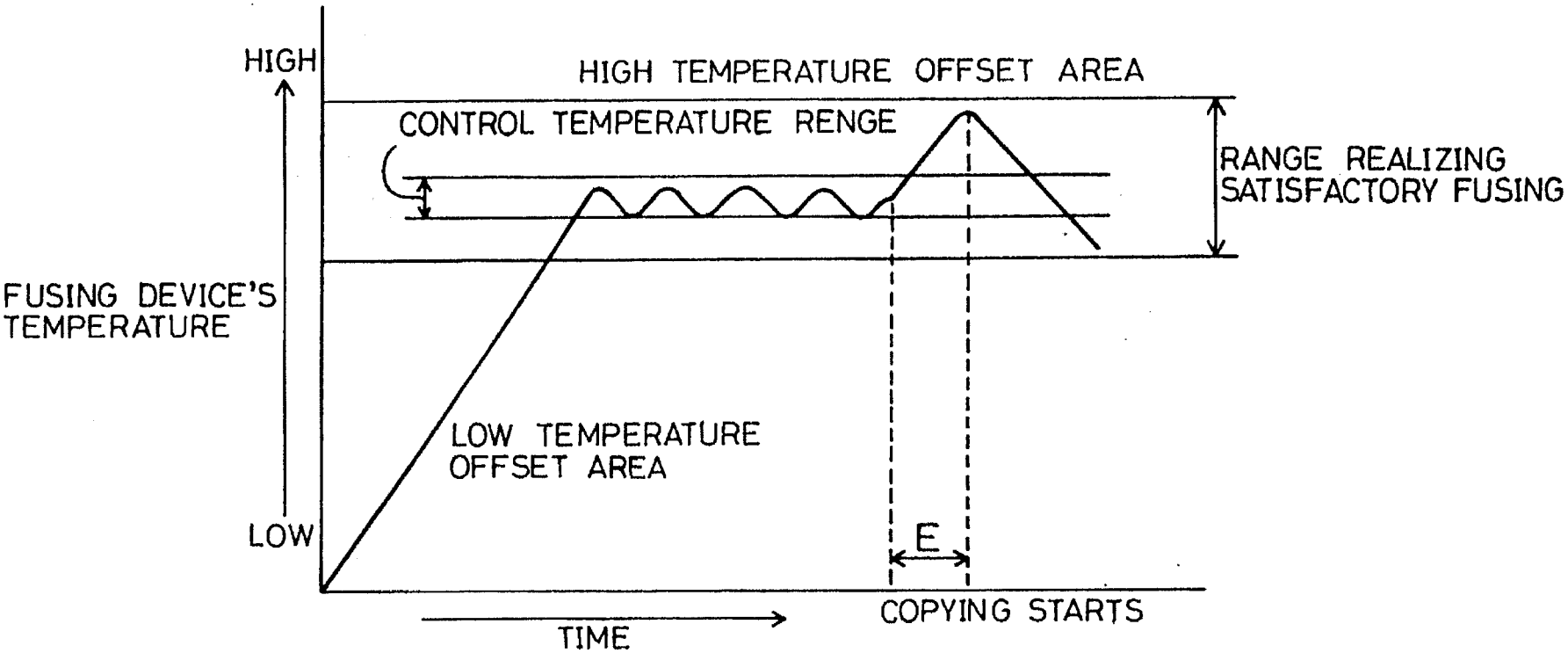
FIG. 23 is a graph showing a result of the temperature control of the fusing device detailed by the flowchart of FIG. 21.
Figure 24:
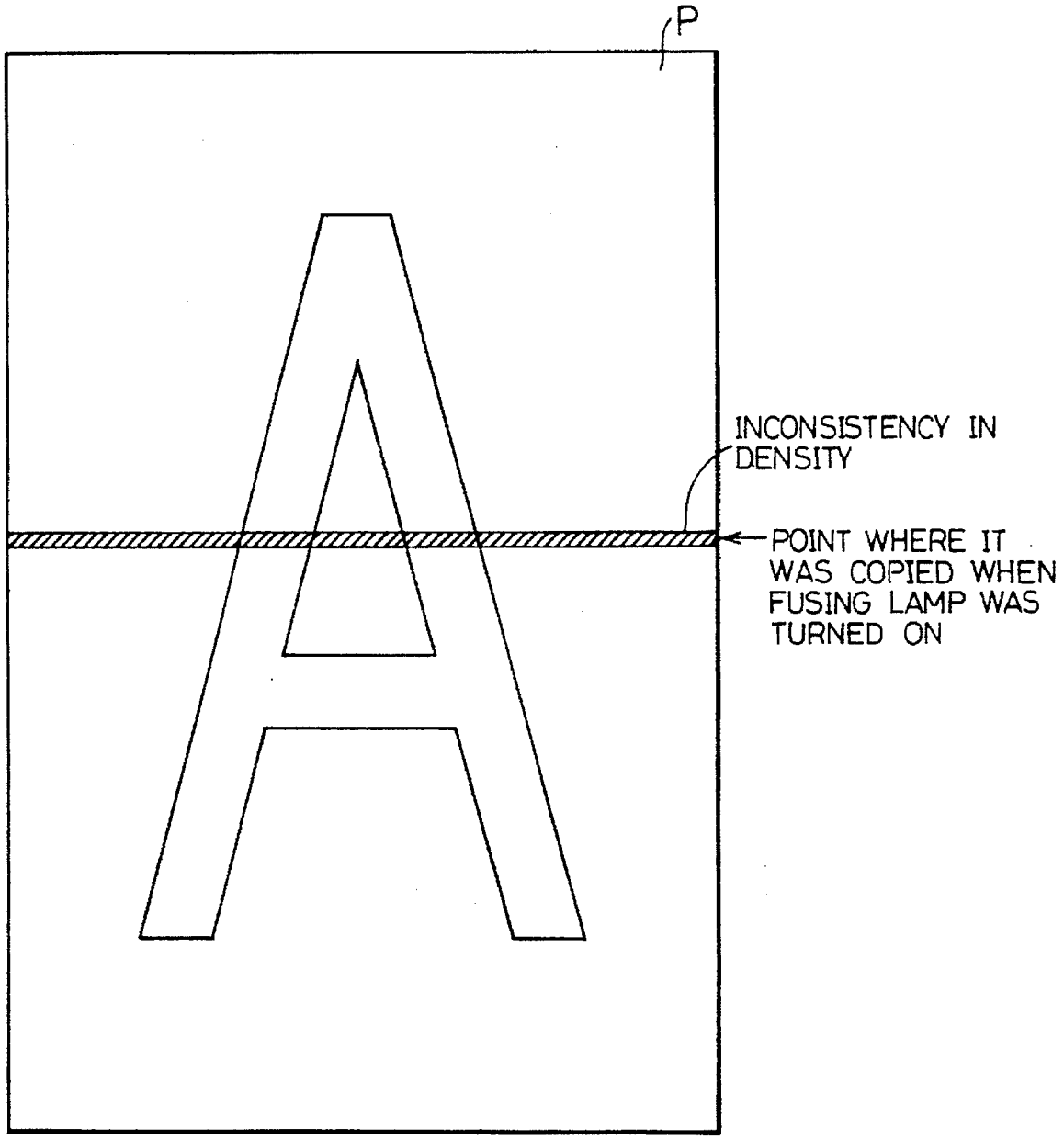
FIG. 24 is a view explaining a resulting copy image with inconsistencies in copy density.

Referring to FIGS. 21 through 23, the following description will describe still another example embodiment of the present invention.

The control on the temperature of the fusing lamp 23 in the electrophotographic apparatus in accordance with the present embodiment will be explained with reference to the flowcharts in FIGS. 21 and 22.

To being with, the CPU 29 is activated when the power is turned on and the CPU 29 carries out the pre-copy procedures, such as paper jam check and display processing (S111). Then, the CPU 29 turns on the fusing lamp 23 for warming up the fusing device 18 and starts the temperature control thereof (S112), and enters the ready state. As shown in FIG. 20, the temperature of the fusing device 18 is controlled in the above-mentioned predetermined control temperature range until the copying operation starts.

Next, when the copy button is pressed (S113), the CPU 29 enters the copy sequence. Subsequently, the CPU 29 pre-sets an on time value E of the fusing lamp 23 (S114), and starts a timer F provided to the CPU 29 as temperature raising time measuring means (S115). The pre-set value referred herein is a time required for the temperature of the upper heat roller 21 to rise from the control temperature range up to the upper limit of the temperature range realizing satisfactory fusing, and pre-programmed in the ROM 30 (temperature raising time storage means).

Next, the CPU 29 checks whether the value of the timer F has reached the pre-set value E (S116). When the value of the timer F has reached the pre-set value E, the CPU 29 turns off the fusing lamp 23 (S117) and resets the timer F (S118).

Next, the CPU 29 turns on the exposing lamp 3 (S119), feeds the optical system 2 (S120), and starts the copying operation. When the feeding of the optical system 2 ends (S121), the CPU 29 turns off the exposing lamp 3 (S122) and starts to return the optical system 2 to its original position (S123). When the optical system 2 has returned to its original position (S124), the CPU 29 checks whether the copying operation has ended or not (S125). When the copying operation has ended and the temperature of the fusing device 18 has not been restored yet, the CPU 29 controls the temperature of the fusing device 18 in the post-copying procedures to restore the temperature thereof. When the copying operation has not ended in S125, namely, when the second copy and thereafter are being made in the multi-copy mode, the CPU 29 proceeds to S126 of the flowchart in FIG. 22.

AS shown in FIG. 22, the CPU 29 checks whether the temperature of the fusing device 18 has reached the control temperature or not (S126). When the temperature of the fusing device 18 has not reached the control temperature, the CPU 29 turns on the fusing lamp 23 again (S127) to raise the temperature of the fusing device 18. When the temperature of the fusing device 18 has reached the control temperature, the CPU 29 turns off the fusing lamp 23 (S128), and returns to Sl14 to start the copying operation again through the same flow.

The copying machine is programmed in such a manner that the post-fused transfer paper P has been released by the time the optical system 2 returns to its original position.

As shown in FIG. 23, the temperature of the fusing device 18 of the present embodiment is controlled in a predetermined control temperature range during the ready state, and after the copying operation starts, the temperature of the fusing device 18 is raised to around the upper limit of the temperature range realizing the satisfactory fusing by forcibly turning on the fusing lamp 23 for a predetermined period first, and thence turning off the fusing lamp 23 to turn on the exposing lamp 3.

As has been explained, the temperature of the fusing device 18 is raised to around the upper limit of the temperature range realizing satisfactory fusing by turning on the fusing lamp 23 forcibly after the copying operation starts and the fusing lamp 23 is turned off afterwards. Although the temperature of the upper heat roller 21 decreases while the exposing lamp 3 stays on (optically scans) by turning off the fusing lamp 23, the temperature of the upper heat roller 21 does not drop below the lower limit of the temperature range realizing satisfactory fusing even after the post-fusing transfer paper P passes through the fusing device 18 and a copy is made. In other words, since the temperature of the upper heat roller 21 remains in the temperature range realizing satisfactory fusing shown in FIG. 23, a satisfactory copy can be produced without causing the low temperature offset or the like.

Since the temperature of the fusing lamp 23 remains in the temperature range realizing satisfactory fusing even if the temperature thereof is not controlled while the exposing lamp 3 stays on, the exposing lamp 3 is hardly affected by the variance in voltage.

Accordingly, it becomes possible to curb inconsistencies in copy density caused when the voltage of the exposing lamp 3 varies by switching the power supply state to the fusing lamp 23 to OFF from ON while a copy is being made. Moreover, an image can be fused in a satisfactory manner, and a resulting image is satisfactory as well.

The predetermined period during which the fusing lamp 23 is forcibly kept turned on is, for example, about 1.5 to 2 seconds if the upper heat roller 21 is 1 mm thick, which raises the temperature of the fusing roller by about 10° C. The temperature range realizing satisfactory fusing is between 140° C. and 170° C. in this case. Note that, however, the upper limit of the temperature range realizing satisfactory fusing varies depending on the materials, namely performance, of the toner and upper heat roller 21.

The exposing lamp 3 made of a halogen lamp is used as the exposing light source in each embodiment above. However, the exposing lamp 3 is not limited to the halogen lamp and may be a fluorescent light or the like. Likewise, although the fusing lamp 23 made of the fusing halogen lamp is used as the fusing heat source, the fusing lamp 23 is not limited to the fusing halogen lamp, and exoergic resistors provided in a self-exoergic fusing roller are also available.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. An electrophotographic apparatus comprising:

an exposing light source for irradiating a light beam onto a document upon receipt of power supply;

a fusing heat source for fusing a non-fused image on a sheet onto said sheet upon receipt of power supply;

a power source for supplying power to said exposing light source and said fusing heat source, said exposing light source and said fusing heat source being connected to said power source in parallel;

voltage variance detecting means for detecting variance in voltage of said exposing light source;

exposing amount control means for controlling a phase of a voltage supplied to said exposing light source based on a feedback result of the variance in voltage detected by said voltage variance detecting means to adjust an amount of light of said exposing light source to a predetermined value;

temperature detecting means for detecting a temperature of said fusing heat source;

fusing temperature control means for stabilizing a temperature of said fusing heat source at a predetermined value by switching an ON state and an OFF state based on a detection result of said temperature detecting means, power being supplied to said fusing heat source from said power source in the ON state while no power being supplied in the OFF state; and phase control data storage means for storing phase control data of said exposing light source, wherein, when said fusing temperature control means switches the power supply to said fusing heat source to OFF from ON state while said exposing light source stays on, said exposing amount control means suspends said phase control based on the feedback and carries out a phase control based on the phase control data stored in said phase control data storage means within a predetermined period before and after the switching.

2. The electrophotographic apparatus as defined in claim 1, wherein said fusing temperature control means inhibits a switching to ON from OFF state of power supply to said fusing heat source while said exposing light source stays on.

3. The electrophotographic apparatus as defined in claim 1, wherein said phase control data are stored in said phase control data storage means as a relation between phase time data and a voltage of said exposing light source when said fusing heat source is switched to OFF from ON state.

4. The electrophotographic apparatus as defined in claim 1, wherein said phase control data are stored in said phase control data storage means as a relation between phase correcting time data and a voltage of said exposing light source when said fusing heat source is switched to OFF from ON state.

5. The electrophotographic apparatus as defined in claim 1, wherein said phase control data storage means stores, as the phase control data, data generated based on data related to variance in voltage of said exposing light source detected before the power supply state to said fusing heat source is switched.

6. The electrophotographic apparatus as defined in claim 5, wherein said phase control data storage means stores, as phase control data, an average value of a plurality pieces of the data related to the variance in voltage of said exposing light source detected before the power supply state to said fusing heat source is switched.

7. The electrophotographic apparatus as defined in claim 1, wherein:

said voltage variance detecting means detects data related to variance in voltage of said exposing light source since a power is turned on until a warm-up ends; and said phase control data storage means stores, as the phase control data, data generated based on data related to variance in voltage detected since the power is turned on until the warm-up ends.

8. The electrophotographic apparatus as defined in claim 7, wherein the data related to the variance in voltage include a voltage V1 of said exposing light source when said exposing light source and said fusing heat source are turned on and a voltage V2 of said exposing light source when said exposing light source is turned on and said fusing heat source is turned off, the phase control data being phase data for making said V1 equal to said V2.

9. The electrophotographic apparatus as defined in claim 8, wherein the phase control data are stored as a relation between a voltage of said exposing light source and phase correcting time data.

10. The electrophotographic apparatus as defined in claim 1 further comprising fusing temperature range storage means for storing a temperature range realizing satisfactory fusing of said fusing heat source, wherein said fusing temperature control means controls power supply from said power source in such a manner that, when said exposing light source is in the OFF state and said fusing heat source is in a pre-fusing state, a temperature of said fusing heat source rises to around an upper limit of the temperature range realizing satisfactory fusing stored in said fusing temperature range storage means.

11. An electrophotographic apparatus comprising:

an exposing light source for irradiating a light beam onto a document upon receipt of power supply;

a fusing heat source for fusing a non-fused image on a sheet onto said sheet upon receipt of power source;

a power source for supplying power to said exposing light source and said fusing heat source, said exposing light source and said fusing heat source being connected to said power source in parallel;

voltage variance detecting means for detecting variance in voltage of said exposing light source;

exposing amount control means for determining a gain of a phase using a feedback amount based the variance in voltage detected by said voltage variance detecting means, and for adjusting an amount of light of said exposing light source to a predetermined value by increasing a phase of a voltage supplied to said exposing light source by said gain;

temperature detecting means for detecting a temperature of said fusing heat source;

fusing temperature control means for stabilizing a temperature of said fusing heat source at a predetermined value by switching an ON state and an OFF state based on a detection result of said temperature detecting means, power being supplied to said fusing heat source from said power source in the ON state while no power being supplied in the OFF state; and phase control data storage means for storing phase control data of said exposing light source, wherein, when said fusing temperature control means switches the power supply to said fusing heat source to OFF from ON state while said exposing light source stays on, said exposing amount control means makes, for a predetermined period, said gain of feedback phase control smaller than a gain when said fusing temperature control means does not switch the power supply state of said fusing heat source while said exposing light source stays on.

12. The electrophotographic apparatus as defined in claim 11, wherein said fusing temperature control means inhibits a switching to ON from OFF state of power supply to said fusing heat source while said exposing light source stays on.

13. An electrophotographic apparatus comprising:

an exposing light source for irradiating a light beam onto a document upon receipt of power supply;

a fusing heat source for fusing a non-fused image on a sheet onto said sheet upon receipt of power supply;

a power source for supplying power to said exposing light source and said fusing heat source, said exposing light source and said fusing heat source being connected to said power source in parallel;

voltage variance detecting means for detecting variance in voltage of said exposing light source;

exposing amount control means for controlling a phase of a voltage supplied to said exposing light source based on a feedback result of variance in voltage detected by said voltage variance detecting means to adjust an amount of light of said exposing light source to a predetermined value;

temperature detecting means for detecting a temperature of said fusing heat source;

fusing temperature control means for stabilizing a temperature of said fusing heat source at a predetermined value by switching an ON state and an OFF state based on a detection result of said temperature detecting means, power being supplied to said fusing heat source from said power source in the ON state while no power being supplied in the OFF state; and fusing temperature range storage means for storing a temperature range realizing satisfactory fusing of said fusing heat source, wherein said fusing temperature control means controls power supply from said power source in such a manner that:

(1) when said exposing light source is in the OFF state and said fusing heat source is in a pre-fusing state, a temperature of said fusing heat source rises to around an upper limit of the temperature range realizing satisfactory fusing stored in said fusing temperature range storage means; and (2) when said exposing light source is in the ON state, a power supply to said fusing heat source stops.

14. The electrophotographic apparatus as defined in claim 13 further comprising:

temperature raising time storage means for storing a time required to raise a temperature of said fusing heat source to around the upper limit of the fusing temperature realizing satisfactory fusing; and temperature raising time measuring means for measuring a time during which said fusing temperature control means raises a temperature of said fusing heat source.

* * * * *